US007380373B2

(12) United States Patent
Crookston

(10) Patent No.: US 7,380,373 B2
(45) Date of Patent: Jun. 3, 2008

(54) TRUSS GUSSET PLATE AND ROOF ANCHOR SAFETY SYSTEM

(76) Inventor: Lawrence A. Crookston, 250 S. Van Buren Ave., Barberton, OH (US) 44203

( * ) Notice: Subject to any disclaimer, the term of this patent is extended or adjusted under 35 U.S.C. 154(b) by 163 days.

(21) Appl. No.: 11/069,819

(22) Filed: Mar. 1, 2005

(65) Prior Publication Data

US 2006/0196140 A1 Sep. 7, 2006

(51) Int. Cl.
*E04B 1/38* (2006.01)

(52) U.S. Cl. ..... 52/127.5; 52/749.12; 52/92.2; 52/712; 182/45

(58) Field of Classification Search ..... 52/749.12, 52/745.21, 127.5, 698, 695, 92.2, 93.1, 712; 182/3, 45; 403/232.1, 235, 241; 411/461, 411/462, 463, 464, 465, 466, 467, 468
See application file for complete search history.

(56) References Cited

U.S. PATENT DOCUMENTS 3,162,719 A * 12/1964 Mulford ..... 52/633
3,423,898 A * 1/1969 Coloney et al. ..... 52/713
3,703,304 A * 11/1972 Losee ..... 411/462
4,910,934 A * 3/1990 Hennings ..... 52/714
4,946,123 A 8/1990 Albert
5,137,112 A * 8/1992 Nichols ..... 182/3
5,143,171 A 9/1992 Glynn et al.
5,165,642 A * 11/1992 Rihaly ..... 248/237
5,248,021 A * 9/1993 Nichols ..... 182/3
5,282,597 A 2/1994 Babcock
5,287,944 A 2/1994 Woodyard
5,346,036 A * 9/1994 Arisman et al. ..... 182/3
5,361,558 A * 11/1994 Thornton et al. ..... 52/698
5,370,202 A 12/1994 Nichols
5,553,685 A 9/1996 Cook
5,558,312 A 9/1996 Brennan
5,595,260 A 1/1997 Jalla
5,687,535 A 11/1997 Rohlf
5,727,646 A 3/1998 Gray
5,730,407 A 3/1998 Ostrobrod
5,850,889 A 12/1998 Rexroad et al.
5,896,719 A 4/1999 Thornton
6,098,746 A 8/2000 Casteneda
6,241,205 B1 * 6/2001 Affrunti ..... 248/237

(Continued)

FOREIGN PATENT DOCUMENTS

GB 2 251 020 A 6/1992

(Continued)

OTHER PUBLICATIONS

Super Anchor Safety, Fall Protection Equipment, Full Line Catalog, 2004, 28 pages.

*Primary Examiner*—Richard E. Chilcot, Jr.
*Assistant Examiner*—Chi Q. Nguyen
(74) *Attorney, Agent, or Firm*—Sand & Sebolt

(57) ABSTRACT

A roof truss connector plate is provided comprising a mounting plate portion and an anchor portion extending from the mounting plate portion. The truss connector plate is a portion of a roof anchor safety system. The anchor portion of the truss connector plate allows various safety components of the roof anchor system to be secured to the roof. The truss connector plates are factory installed when the roof truss is formed and provide certifiable anchor capacity to the user.

14 Claims, 25 Drawing Sheets

U.S. PATENT DOCUMENTS

| | | | | |
|---|---|---|---|---|
| 6,691,826 | B1 | 2/2004 | Dean | |
| 6,705,018 | B2 * | 3/2004 | Guhse | 33/414 |
| 6,779,316 | B2 * | 8/2004 | Carroll | 52/698 |
| 6,786,020 | B2 | 9/2004 | Poldmaa | |
| 6,877,291 | B2 * | 4/2005 | Shamroukh et al. | 52/702 |
| 6,966,531 | B2 * | 11/2005 | Curtin | 248/237 |
| 2003/0051429 | A1 | 3/2003 | Hovenier | |

FOREIGN PATENT DOCUMENTS

| | | |
|---|---|---|
| GB | 2 291 100 A | 7/1994 |
| GB | 2 397 845 A | 4/2004 |

* cited by examiner

TRUSS GUSSET PLATE AND ROOF ANCHOR SAFETY SYSTEM

TECHNICAL FIELD

This invention relates to a roof truss connector plate and roof anchor safety system and, in particular, to a connector plate comprising an anchor portion extending therefrom. The anchor portion allows various components of the roof anchor system to be secured to the roof. The truss connector plates are factory installed when the roof truss is formed and provide certifiable anchor capacity to the user.

BACKGROUND OF THE INVENTION

The need for securing roofing workers on pitched roofs is well known and is now being required by many government regulations. Many safety systems have been developed to secure workers, with the majority involving an anchor attached to either a rafter of a truss or to the surface of the roof. These prior art anchor systems may be temporary or permanent.

A problem with all of these prior art systems is that they rely on a roofing worker to initially attach the anchor. This often can result in the anchor being attached incorrectly. The potential misconnection of anchor bolts, screws and brackets, and the resulting personal injury, is a serious problem with the prior art safety systems. Additionally, due to the potential liability, building contractors many times retain independent sub-contractors that are expected to provide proper protection, but many times fail to do so. The difficulty and potential for improper installation lead to disastrous results if a roof worker should fall, and the need therefore exists for a simple, integrated approach to provide roof safety to every construction site.

Accordingly, there is need for providing a roof anchor system that overcomes problems associated with the prior art.

SUMMARY OF THE INVENTION

The present invention overcomes at least one disadvantage of the prior art by providing a monolithic truss connector plate comprising a first mounting plate portion having a plurality of teeth extending perpendicularly therefrom, and a first anchor portion extending from the mounting plate portion and including a means for attaching at least one safety device. The roof system may therefore have the anchor system as a factory installed product in association with the building materials. This, and other advantages, will be apparent upon a review of the drawings and detailed description of the invention.

At least one embodiment of the present invention also provides a roof anchor safety system comprising a pair of truss connector plates, each truss connector plate comprising a mounting plate portion having a plurality of teeth extending perpendicularly therefrom and an anchor portion extending from the mounting plate portion, wherein the mounting plate portion of the truss connector plates are attached to opposite sides of a truss such that the anchor portion of each truss connector plate extends beyond an edge of the truss and outward from the truss, and at least one safety device supported by the truss connector plates.

At least one embodiment of the present invention also provides a method of providing a roof anchor safety system comprising the steps of providing a truss connector plate comprising a mounting plate portion having a plurality of teeth extending perpendicularly therefrom and an anchor portion extending from the mounting plate portion, the anchor including means for attaching a safety device; attaching the mounting plate portion of the truss connector plate to a truss such that the plurality of teeth engage a wooden portion of the truss and the anchor portion extends beyond an edge of the truss and outward away from the truss.

The roof system may therefore have the anchor system as a factory installed product in association with the building materials. This, and other advantages, will be apparent upon a review of the drawings and detailed description of the invention.

BRIEF DESCRIPTION OF THE DRAWINGS

This invention will now be described in further detail with reference to the accompanying drawings, in which.

DETAILED DESCRIPTION OF THE INVENTION

Figure 1B:
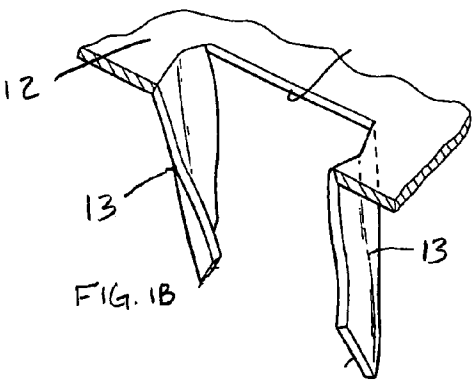
FIG. 1A is a front view of a peak gusset of a roof anchor system of the present invention and FIG. 1B is a detail perspective view of one of the plurality of teeth of the peak gusset of FIG. 1A.
Figure 1A:
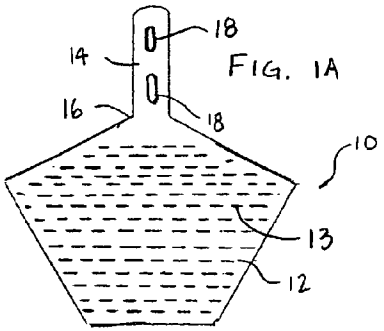

The present invention is directed to an integrated roof safety system wherein successful attachment of this device is assured because it is designed to be installed under ideal and regulated factory conditions. The provision of this device, by the general building contractor, for use by the various hired subsequent subtrades, will create a safe workplace and cause more compliance with existing government regulations. The result will be practical, economical and failsafe product and system. The roof anchor safety system 110 of the present invention will now be described in detail with reference to various embodiments thereof. Referring now to FIG. 1A, a truss connector plate 10 for use at the peak of a truss and referred to herein as a peak gusset 10 is shown and comprises the primary component of the roof anchor safety system 110. The peak gusset 10 comprises a plate 12 of steel having a plurality of teeth 13 formed from the plate 12 and extending perpendicularly from the plate 12 as best shown in FIG. 1B. Referring back to FIG. 1A, the exact shape of the plate being unimportant, it is only necessary that the plate be of sufficient size and geometry to resist anticipated pull forces. The peak gusset 10 further comprises an anchor portion 14 extending from the peak side 16 of the gusset 10. The peak gusset 10 is monolithic such that the anchor portion 14 is an extension of the plate 12. The anchor portion 14 includes a means for attachment 18 of other safety items, the attachment means shown herein as a pair of apertures 18 in the form of slot 18. It is noted that other attachment means are contemplated such as an open slot for engaging a stud of the type used for bayonet connection, or other known connection devices. The thickness of the gusset 10 may be of a standard gusset thickness, typically 16-20 gauge, or may be made of a thicker gauge for added strength.

Figure 2:
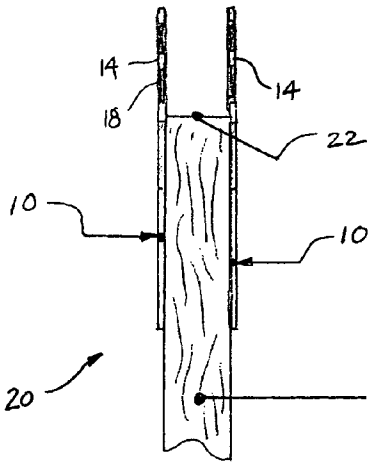
FIG. 2 is a side view of a pair of peak gussets, as shown in FIG. 1, attached to a truss rafter.

A peak gusset 10 is attached to either side of a truss peak 22 as shown in FIG. 2. The plurality of teeth (not shown) are pressed into the wooden truss peak 22 during manufacture of the truss 20 typically using a roll or hydraulic press. Manufacture of the truss is accomplished at the factory under standard environmental conditions to control the quality and strength of the truss. The anchor portion 14 extends outward from the truss peak 22. At least one aperture 18 provides a connection location for other elements of the roof anchor safety system 110. Although not shown, it is contemplated that the anchor portion 14 can be formed with vertically extending ribs in a pressed single or multiple wave or corrugated type configuration to add additional strength to the anchor portion 14 of the gusset 10. Between the manufacture and installation of the truss 20, the anchor portion 14 may be covered with a protective coating or covering (not shown) such as foam wrap or the like in order to protect the anchor portion 14 as well as workers handling the truss 20. A wooden piece of scrap material may also be inserted between the anchor portions 14 and temporarily secured to provide additional protection against bending or other damage to the anchor portions 14 during handling and transportation.

Figure 3:
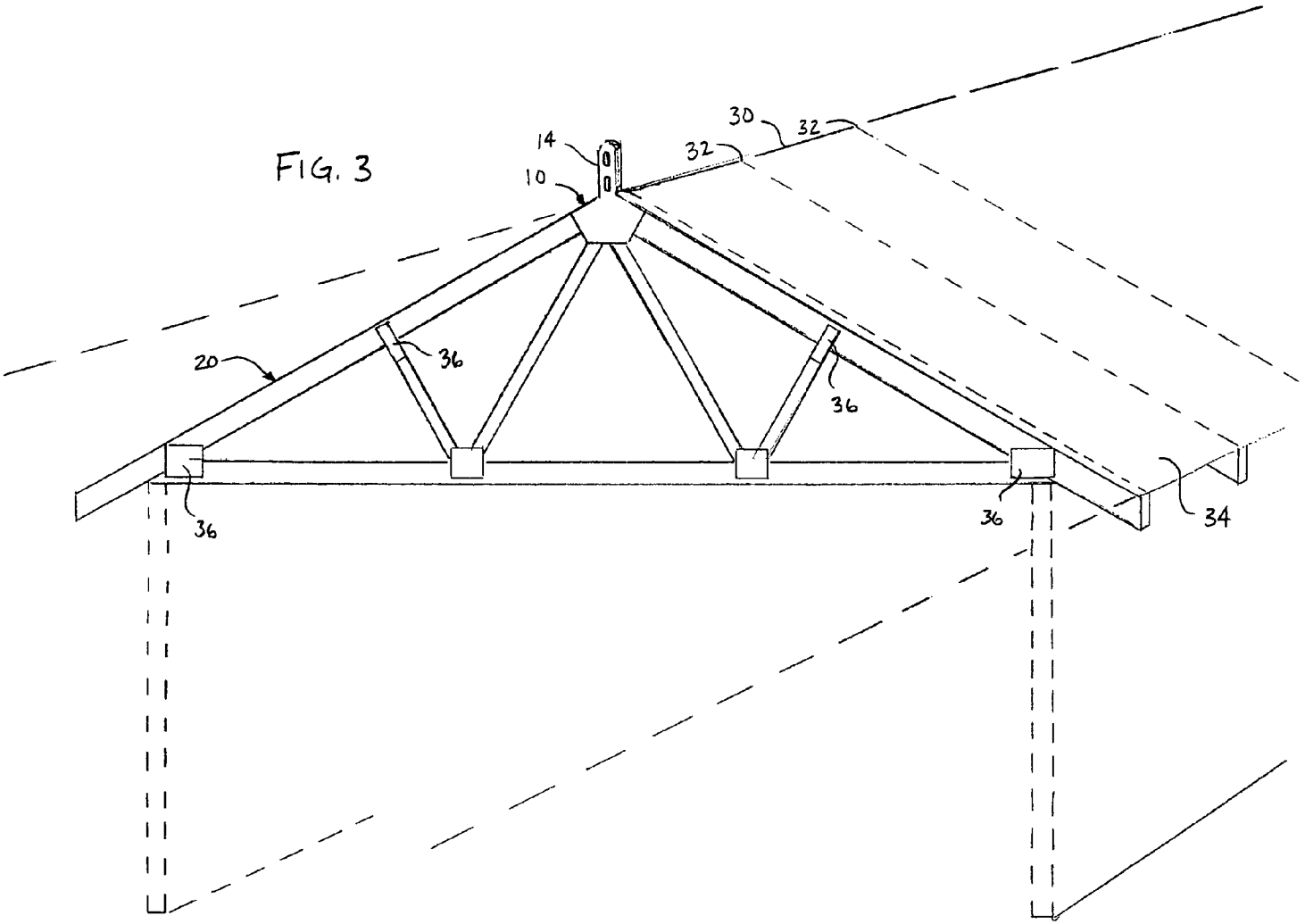
FIG. 3 is a perspective view of a truss formed with the peak gussets of FIG. 1 and shown with a building structure generally shown in phantom.

The resulting truss 20 is shown in FIG. 3 with the peak gusset 10 positioned such that the anchor portion 14 of the gusset 10 extends upward from a ridge line 30 formed by the other truss peaks 32 of the roof 34 (shown in phantom). The anchor portion 14 provides an attachment location for D-rings, hooks, cables, and other means of securing a person while working on the roof 34. It is important to note that, although the peak gusset 10 is shown in the present disclosure solely at the peak of a truss 20, it is contemplated that the other truss connection plates 36 could be configured with an anchor portion 14 as well.

Figure 4:
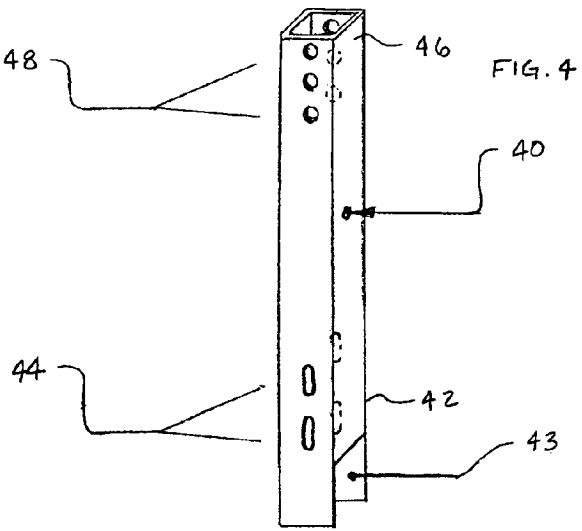
FIG. 4 is a perspective view of a high reach accessory of the roof anchor system of the present invention.

The roof anchor system 110 of the present invention further comprises an anchor extension member 40 referred to as a high reach accessory 40 as shown in FIG. 4. The high reach accessory 40 is essentially an extension bar of a predetermined length that attaches at a first end 42 to the peak gusset 10. The first end 42 may also include sidewall extensions 43 that extend over the sides of the truss peak 22 to provide additional stability and prevent low-impact side-to-side collapse of the anchor portions 14 of the gussets 10. The first end 42 fits over the anchor portions 14 and includes an attachment means 44 for securing the high reach accessory 40 to the anchor portions 14 herein shown as apertures 44 in the form of slots 44. The opposite end 46 of the high reach accessory 40 includes attachment means 48 for attachment of other safety items, the attachment means 48 shown herein as a plurality of apertures 48.

Figure 5:
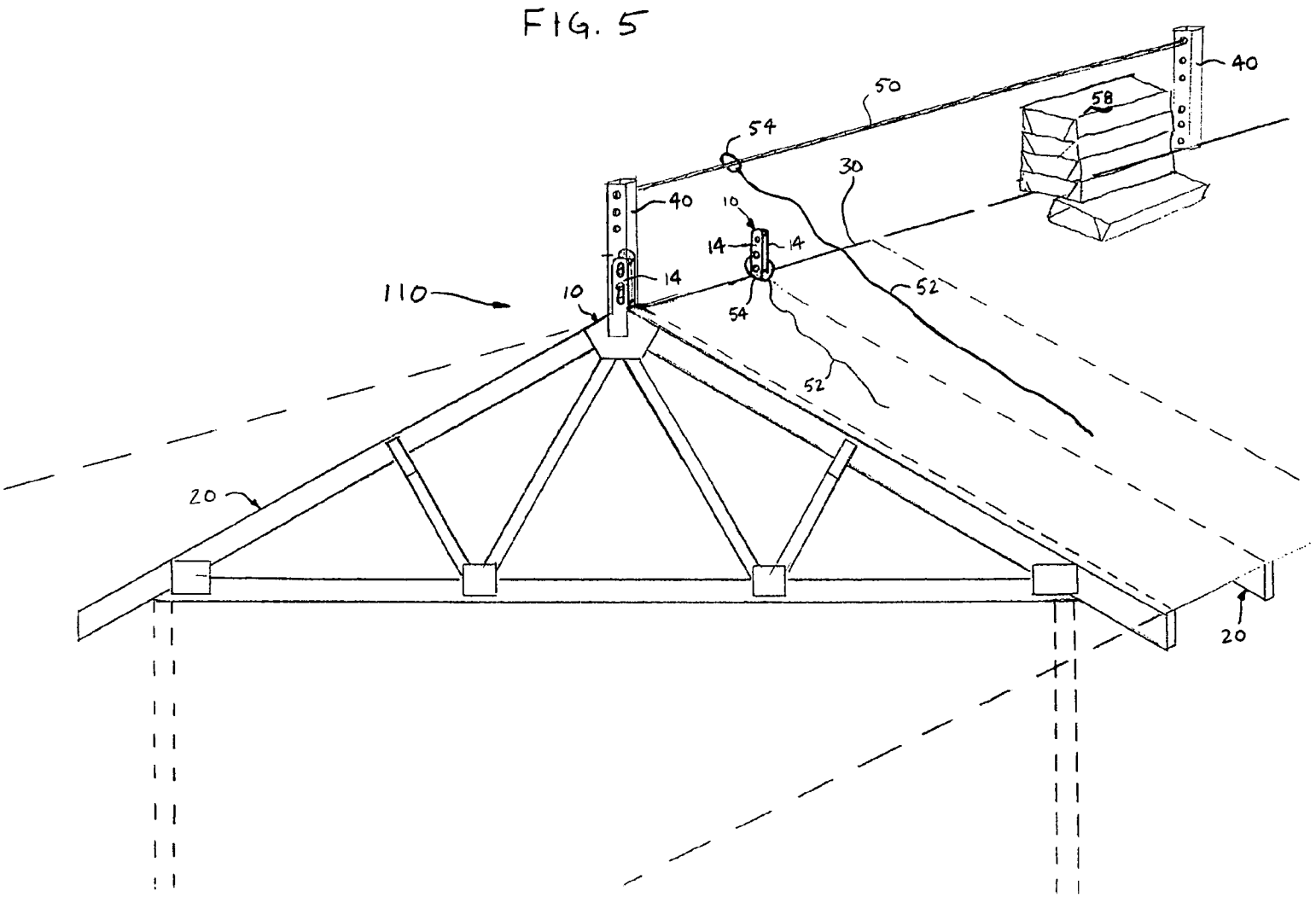
FIG. 5 is a perspective view of a roof having the roof anchor system of the present invention attached thereto.

The roof anchor safety system 110 of the present invention is shown in FIG. 5. A truss 20 is shown having peak gussets 10 attached thereto. A high reach accessory 40 is shown attached over the anchor portion 14 (shown as visible even though covered) of the peak gussets 10. A second high reach accessory 40 is attached to a second peak gusset (not shown) further down the ridge line 30. A tether line 50 is attached to and extends between the high reach accessories 40. A harness line 52 is shown slidably attached to the tether line 50 by an attachment ring 54. An additional truss 20 is shown having peak gussets 10 and is positioned between the two high reach accessories 40. A harness line 52 is shown attached to the anchor portions 14 of the peak gussets 10 by an attachment ring 54. Squares of shingles 58 are shown positioned along the ridge line 30.

Figure 6:
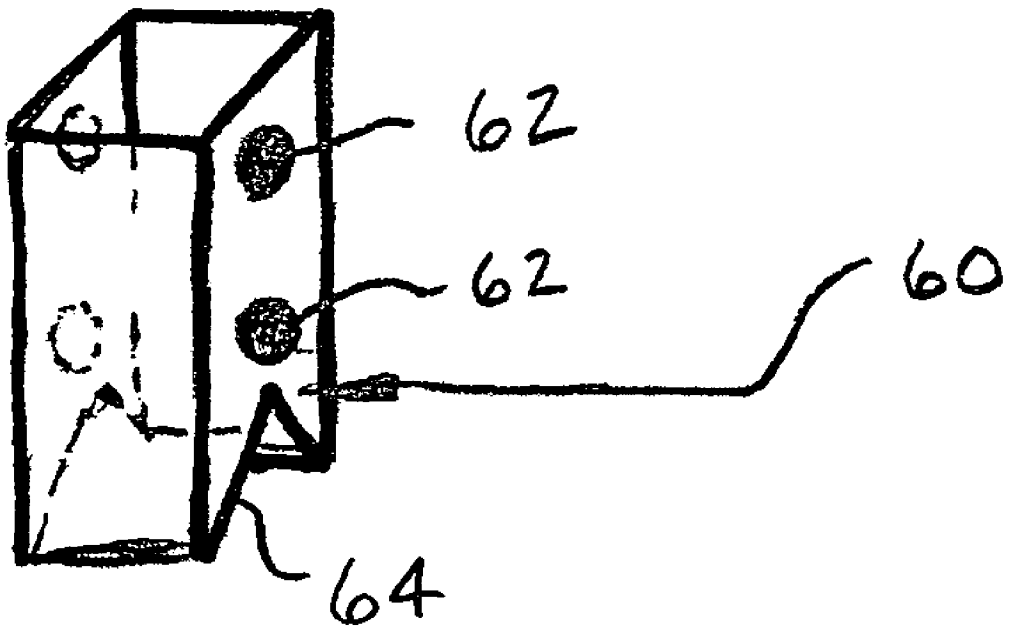
FIG. 6 is a perspective view of a support ferrule insert of the roof anchor system of the present invention.

In FIG. 6, a support ferrule insert is shown for insertion between the anchor portions 14 of the gussets 10 to provide additional support and strength to the anchor portions 14. The support ferrule 60 includes apertures 62. The support ferrule 60 is shown as a tubular member or it may be a solid block. The support ferrule 60 is positioned prior to attachment of the high reach accessory 40. The support ferrule 60 may also include a first end 64 that is formed at an angle to mate with or bridge the peak of the truss 20 and provides additional support to prevent front-to-back low impact collapse of the anchor portions 14 of the gussets 10.

When the roof anchor safety system 110 is no longer needed, the harnesses 52, tether lines 50, high reach accessories 40, D-rings 54 and the like, and support ferrule inserts 60, are removed from the anchor portions 14 and used again as needed. The anchor portions 14 are typically cut near the top of the truss 20 and then folded over the top of the truss 20. Alternatively, the anchor portions 14 may not need to be cut but rather just be bent over the truss 20 and positioned below the roof. It is also contemplated that the anchor portions 14 may be covered and left in place, with or without a ferrule insert support 60 between the extensions 14.

Figure 8:
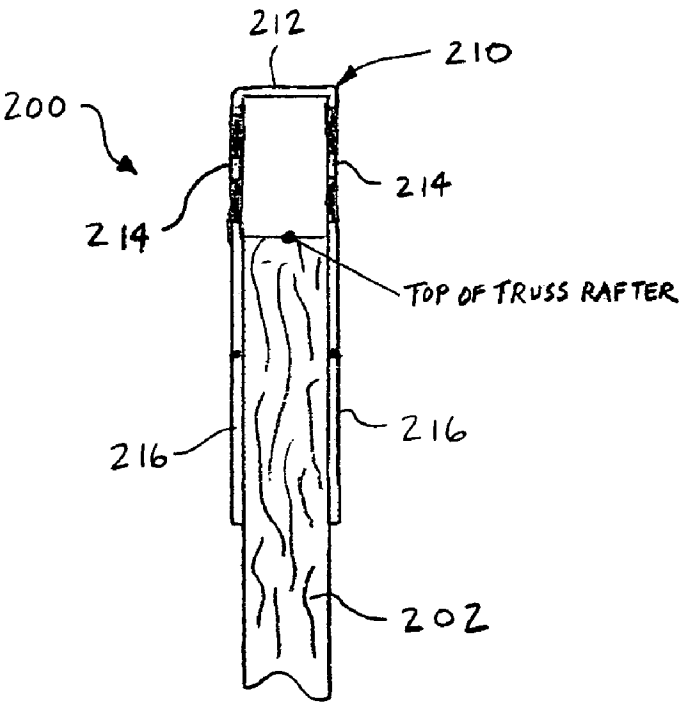
FIG. 8 is a side view of the double gusset of FIG. 7 shown attached to a truss rafter.
Figure 7:
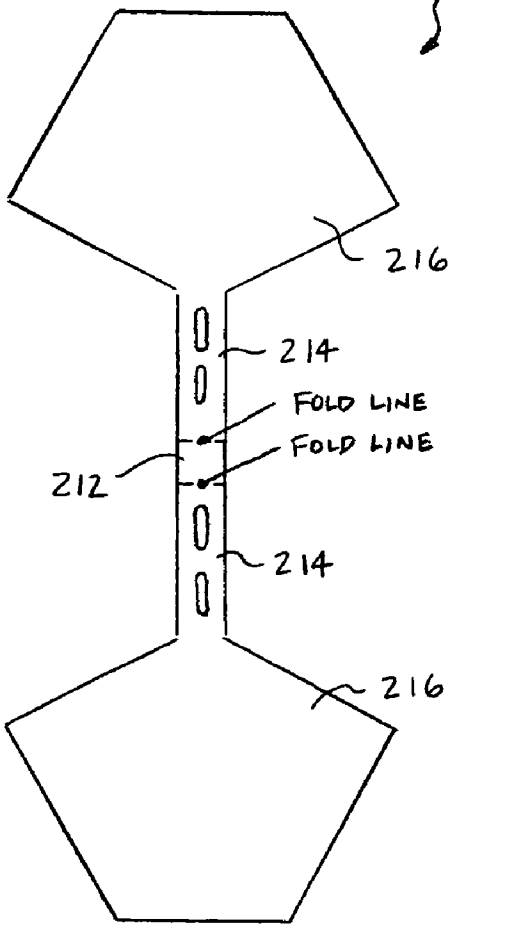
FIG. 7 is a front view of a second embodiment of the peak gusset of the present invention shown in a single piece configuration.
Figure 9:
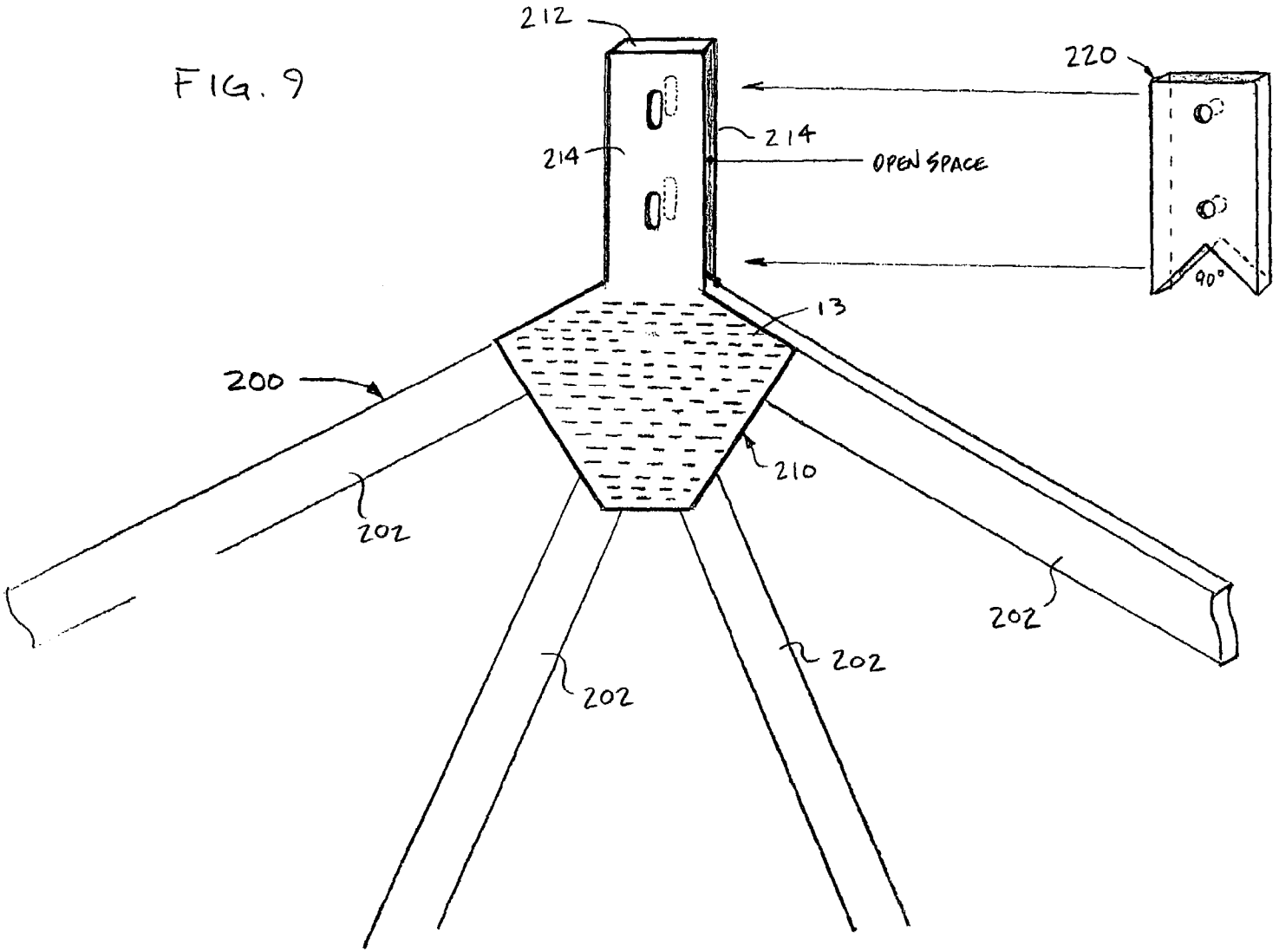
FIG. 9 is a partial perspective view of a truss formed with the double peak gusset of FIG. 7 and a support ferrule of FIG. 6 shown exploded therefrom.

In FIGS. 7-12, two additional embodiments of the peak gusset 210, 310 are shown that are manufactured as one piece and then folded prior to attachment to form the truss 200, 300. Referring now to FIG. 7, a double peak gusset 210 is shown having a connection portion 212 between the anchor portions 214 of the double gusset 210. A plurality of teeth (not shown) extend perpendicularly from each plate portion 216. The double peak gusset 210 is folded on either end of connection portion 212 and attached to form a truss 200 by the plurality of teeth (not shown) engaging the truss members 202 as shown in FIG. 8. The attached peak gusset 210 is shown in a partial perspective view in FIG. 9. The peak gusset anchor portions 214 remain connected by connection portion 212, providing enhanced strength of the anchor portions 214. A support ferrule insert 220 is shown as insertable between the anchor portions 214 and underneath the connection portion 212.

Figure 11:
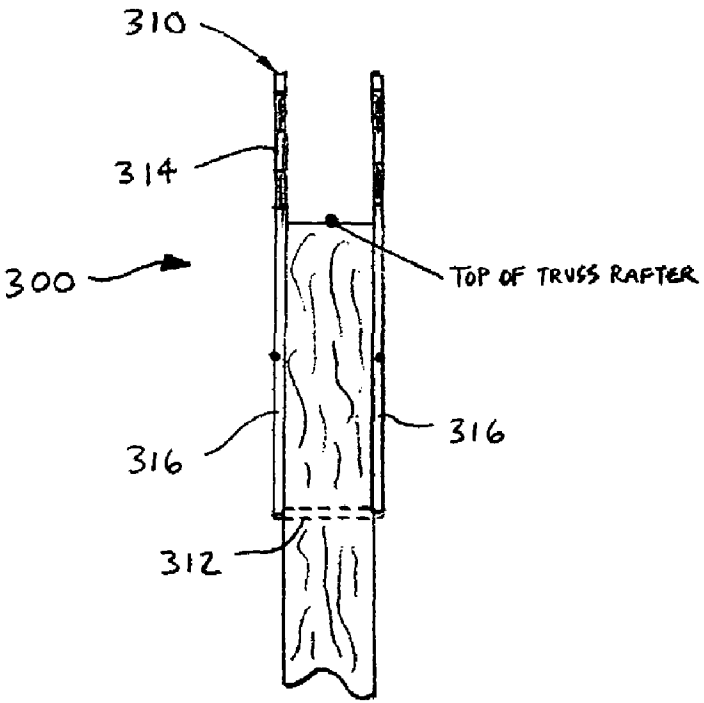
FIG. 11 is a side view of the double gusset of FIG. 10 shown attached to a truss rafter.
Figure 10:
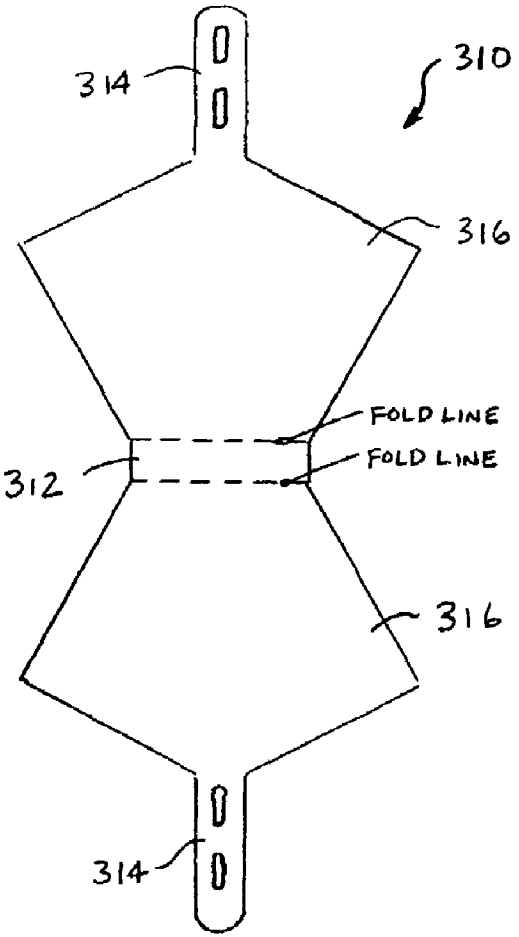
FIG. 10 is a front view of another embodiment of the peak gusset of the present invention shown in a single piece configuration.
Figure 12:
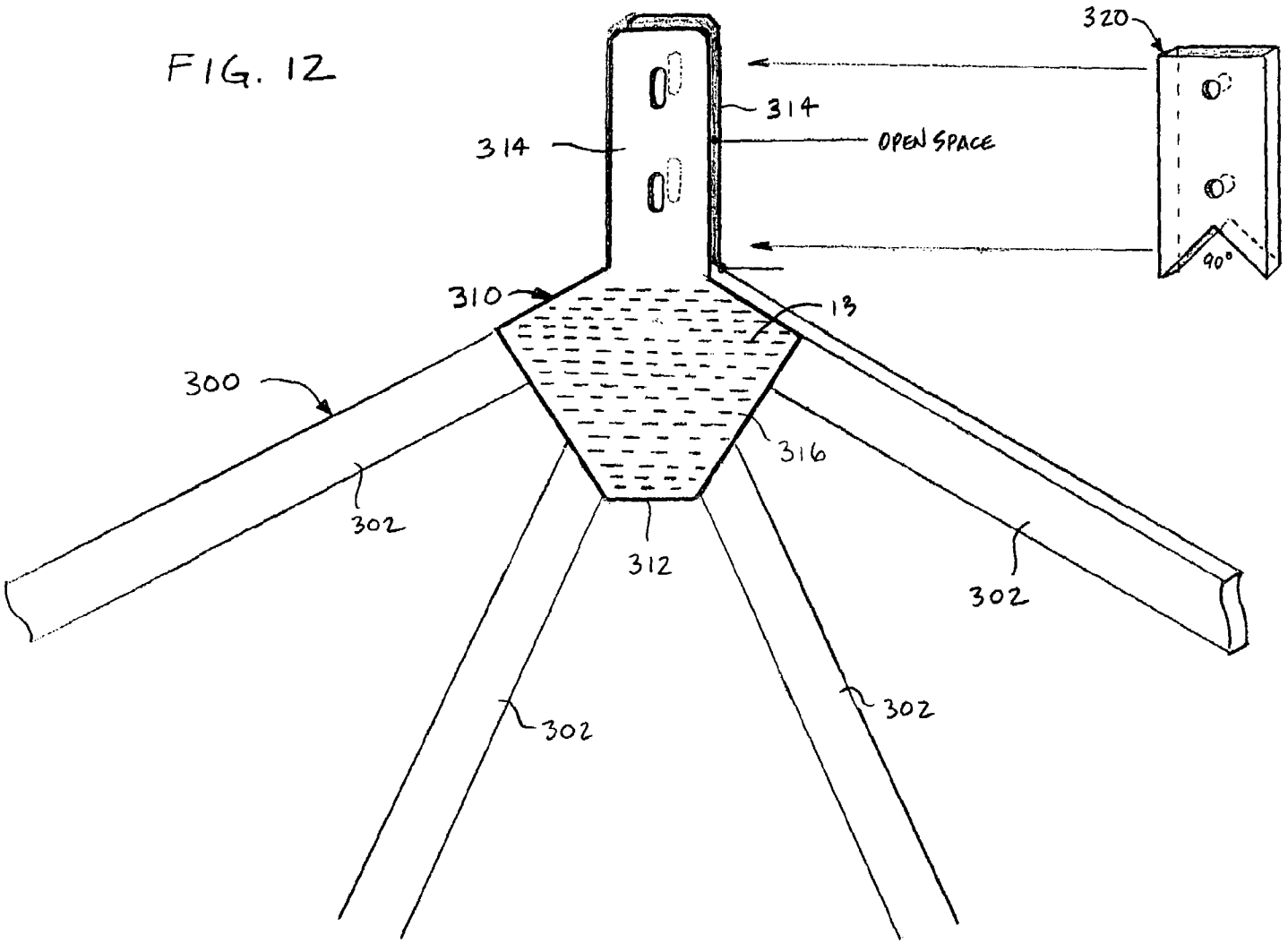
FIG. 12 is a partial perspective view of a truss formed with the double peak gusset of FIG. 10 and a support ferrule of FIG. 6 shown exploded therefrom.

Referring now to FIG. 10, another embodiment of a double peak gusset 310 is shown having a connection portion 312 between the plate portions 316 of the double gusset 310. A plurality of teeth (not shown) extend perpendicularly from each plate portion 316. The double peak gusset 310 is folded on either end of connection portion 312 and attached to form truss 300 by the plurality of teeth (not shown) engaging the truss members 302 as shown in FIGS. 11 and 12. The attached peak gusset 310 is shown in a partial perspective view in FIG. 12. The peak gusset plate portions 316 remain connected by connection portion 312. A support ferrule insert 320 is shown as insertable between the anchor portions 314 as shown in previous embodiments.

Figure 13:
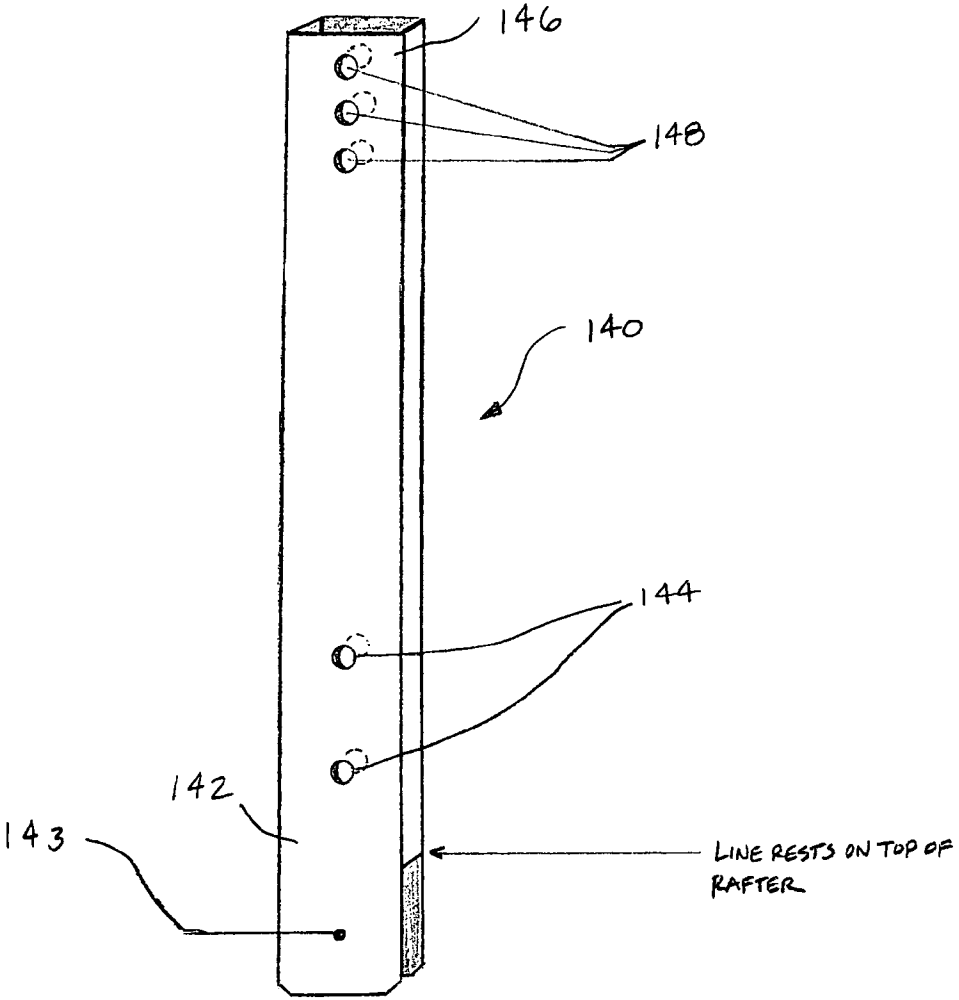
FIG. 13 is a perspective view of another embodiment of the high reach accessory of the roof anchor system of the present invention.
Figure 14:
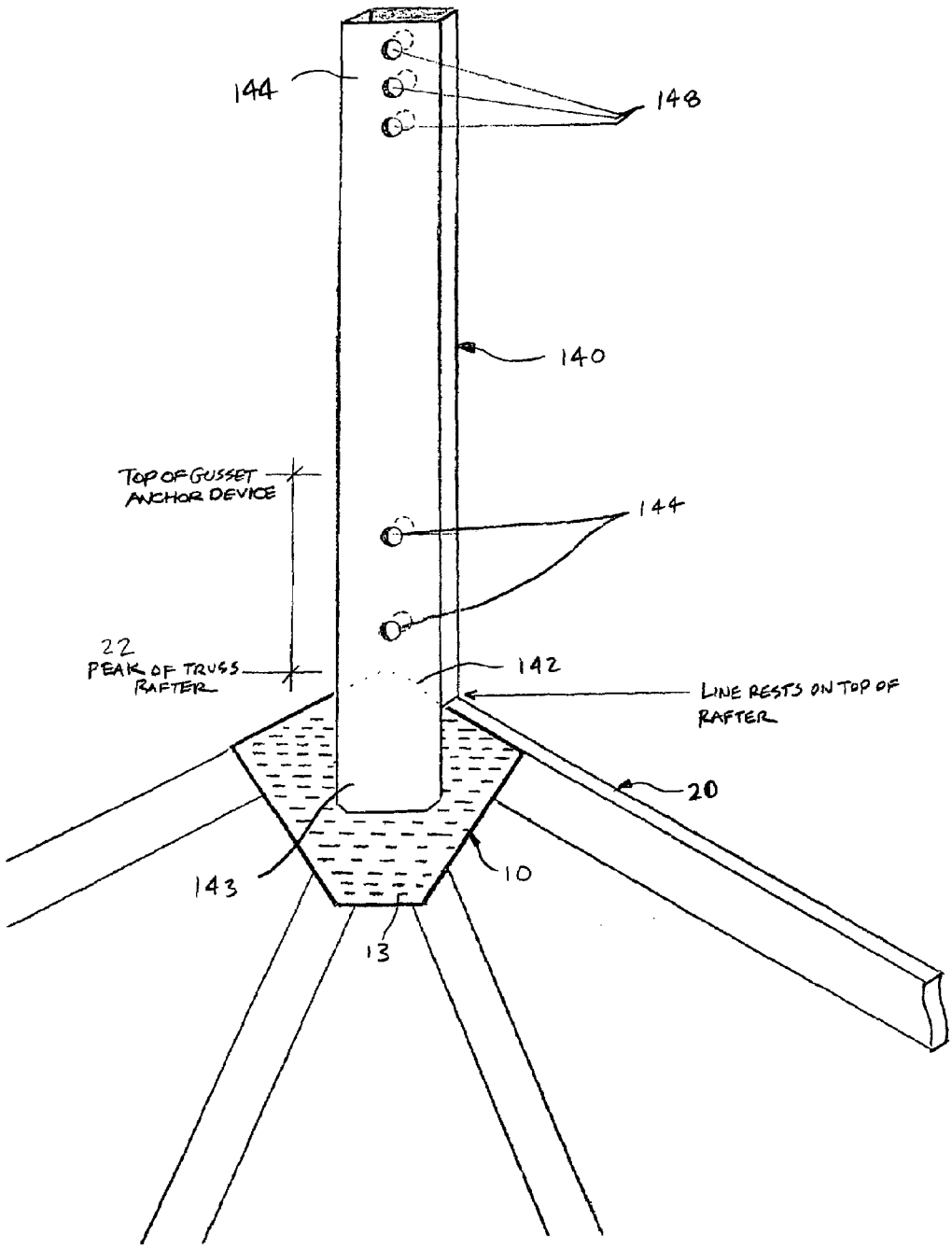
FIG. 14 is a perspective view of a high reach accessory of FIG. 13 shown attached over a portion of a truss using the peak gusset of the present invention.

A variation of the high reach accessory 140 is shown in FIG. 13. The high reach accessory 140 is similar to the previous embodiment of the high reach accessory 40 except that it has a rectangular tubular cross-section as opposed to a square cross-section, and apertures 144 at the first end 142 are circular as opposed to slots. The invention is not limited to a particular configuration of the high reach accessory 40, 140. As with the previous embodiment, the high reach accessory 140 also may include sidewall extensions that extend over the sides of the truss peak 22 to provide additional stability and prevent low-impact side-to-side collapse of the anchor portions 14 of the gussets 10 as best shown in FIG. 14. The first end 142 fits over the anchor portions 14. As with the previous embodiment, the opposite end 146 of the high reach accessory 140 includes attachment means 148 for attachment of other safety items, the attachment means 148 shown herein as a plurality of apertures 148.

Figure 15:
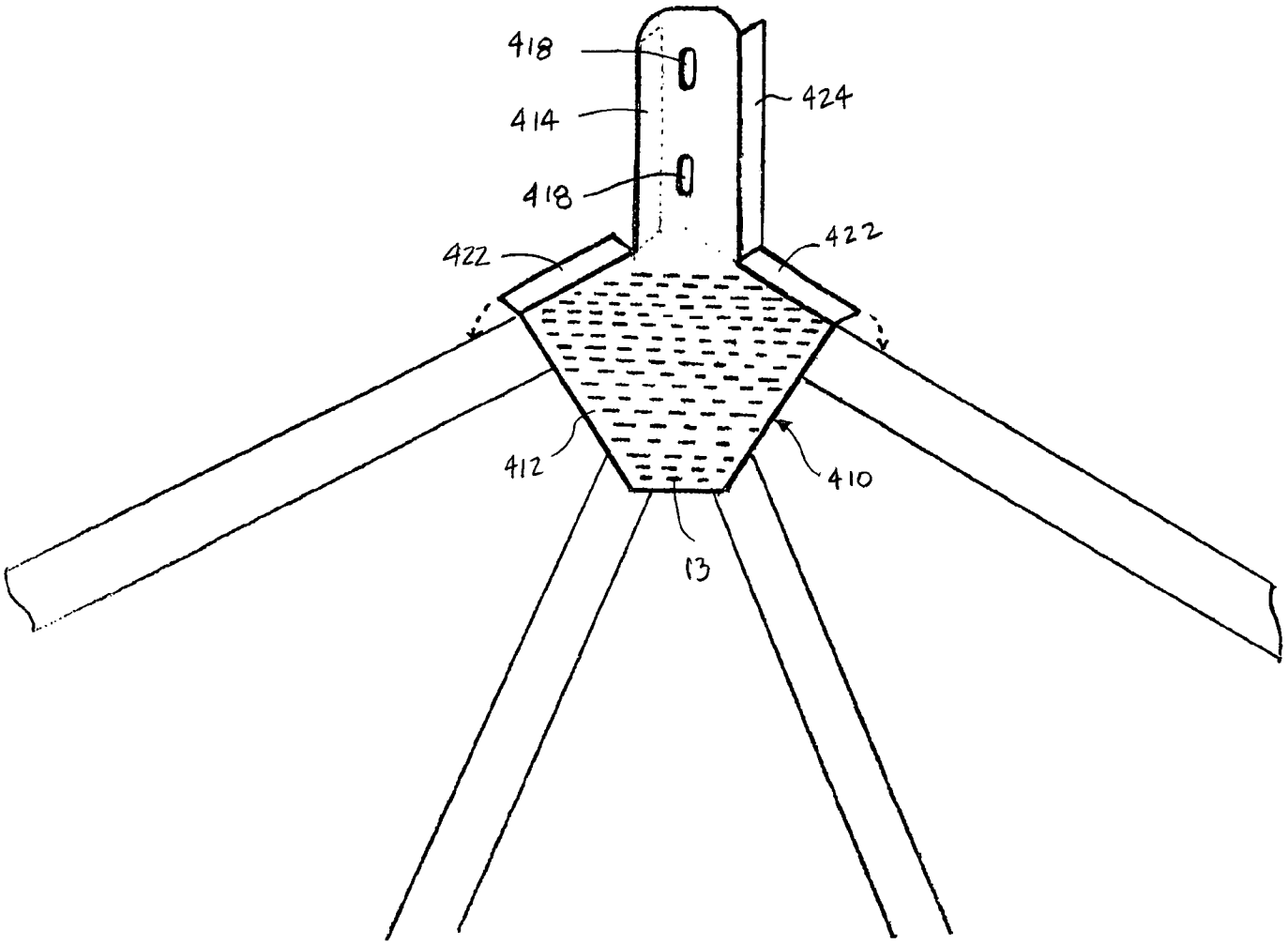
FIG. 15 is a partial perspective view of another embodiment of the peak gusset having fold over side reinforcements, shown attached to a plurality of truss rafters and truss webs.

Another embodiment of the peak gusset 410 is shown in FIG. 15. The peak gusset comprises a plate 412 of steel having a plurality of teeth (not shown) formed from the plate and extending perpendicularly from the plate 412. The peak gusset 410 further comprises an anchor portion 414 extending from the peak side of the gusset 410. The anchor portion 414 includes a means for attachment 418 of other safety items, the attachment means shown herein as a pair of apertures 418. Gusset 410 includes reinforcing flaps 428 extending from the anchor portion 414 and reinforcing flaps 422 extending from the plate 412. When a peak gusset 410 is attached to either side of a truss 400, the flaps 412,422 of each gusset are folded perpendicular to their respective gussets 410, and provide additional support for the anchor portion 414. A support ferrule insert (not shown) may still be used, if needed, and is insertable through an opening at the top of the anchor portions 414 of the gussets 410.

Figure 16:
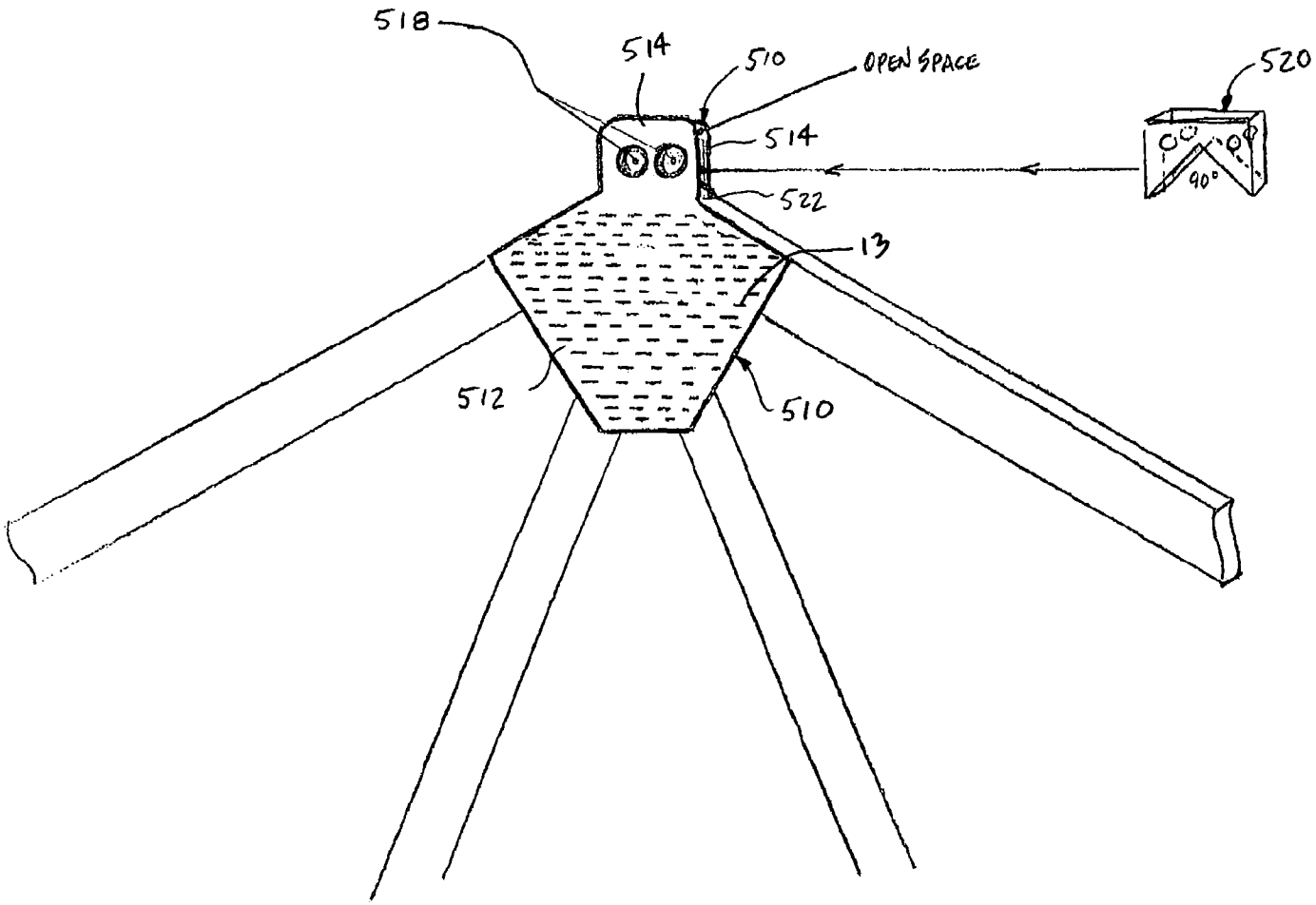
FIG. 16 is a partial perspective view of another embodiment of the peak gusset having a low profile attachment extension, shown attached to a plurality of truss rafters and truss webs.
Figure 17:
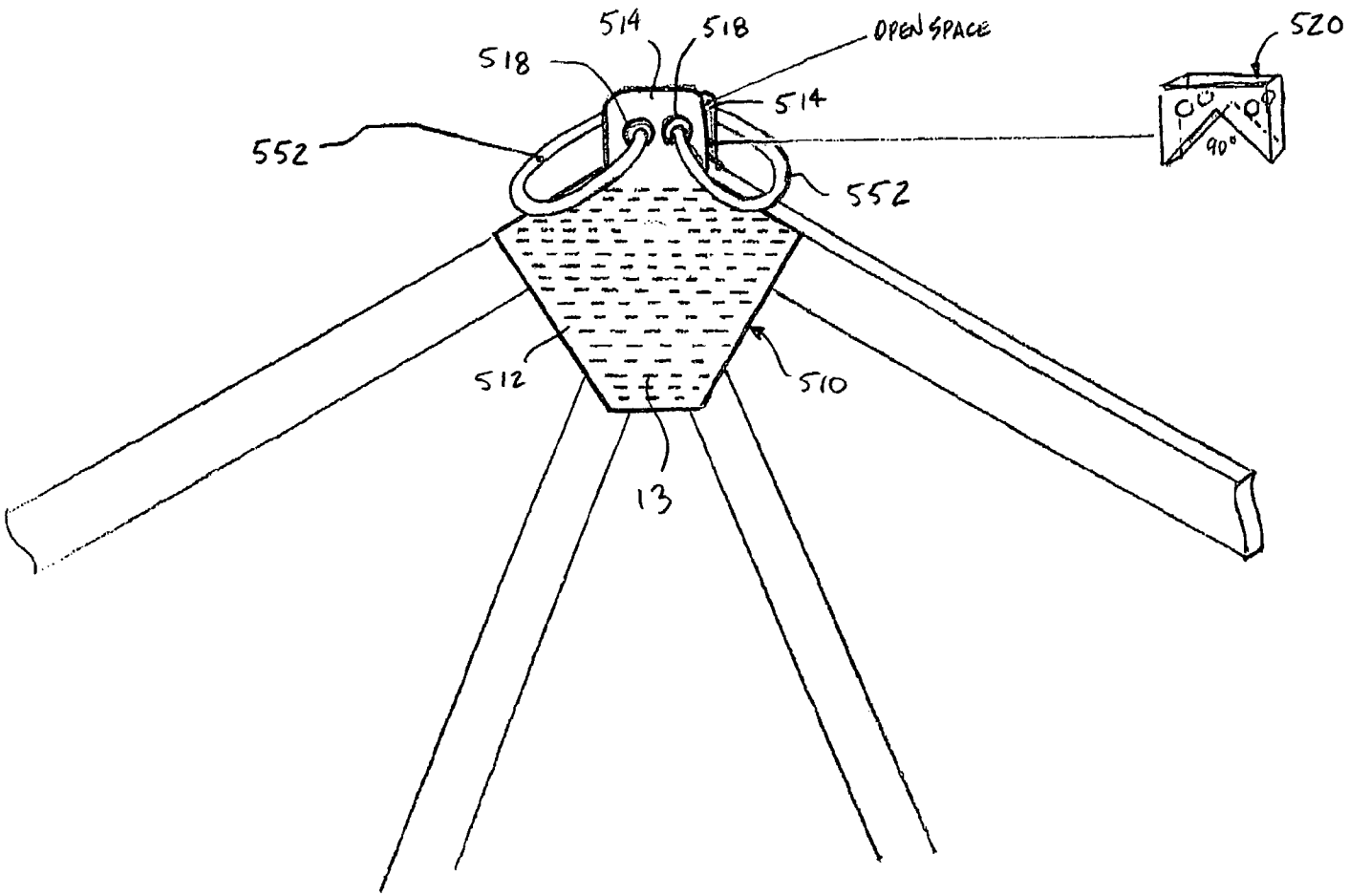
FIG. 17 is a partial perspective view of the peak gusset as shown in FIG. 16 having a plurality of D rings attached thereto for a cable harness hook up.

Another embodiment of the peak gusset 510 is shown in FIGS. 15 and 16. The peak gusset comprises a plate 512 of steel having a plurality of teeth (not shown) formed from the plate and extending perpendicularly from the plate 512. The peak gusset 510 further comprises an anchor portion 514 extending from the peak side of the gusset 510. The anchor portion 514 includes a means for attachment 518 of other safety items, the attachment means shown herein as a pair of apertures 518. A peak gusset 510 is attached to either side of a truss peak 522. A support ferrule insert 520 is shown as insertable between the anchor portions 514 as shown in previous embodiments. In FIG. 17, a pair of D-rings 552 are shown attached to the peak gusset 510.

Figure 19:
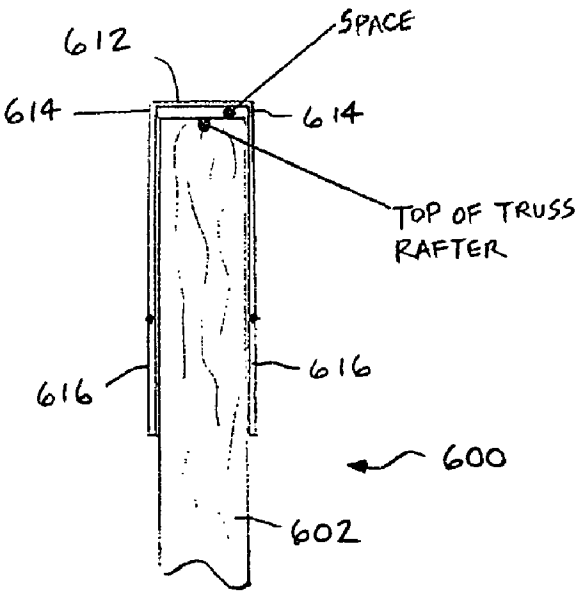
FIG. 19 is a side view of the peak gusset of FIG. 18, shown attached to a truss rafter.
Figure 18:
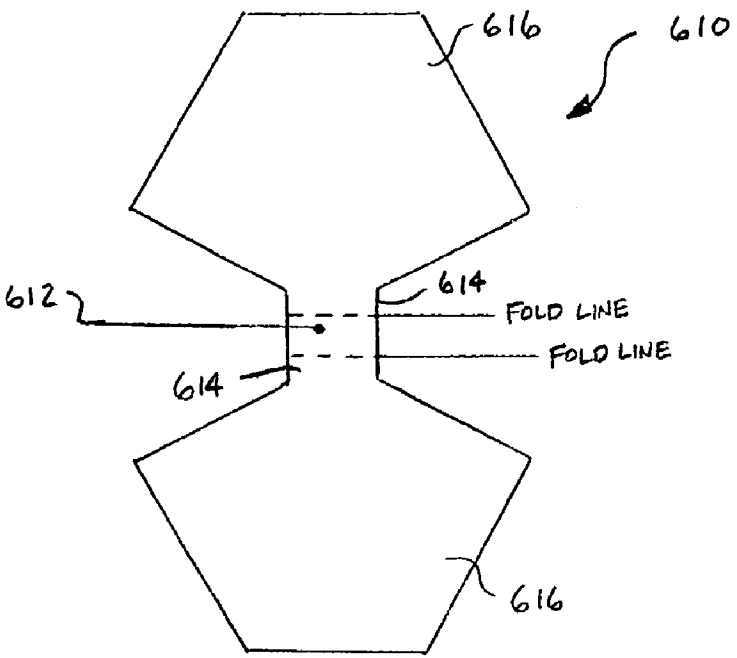
FIG. 18 is a front view of a low anchor profile embodiment of the peak gusset of the present invention shown in a single piece configuration.
Figure 20:
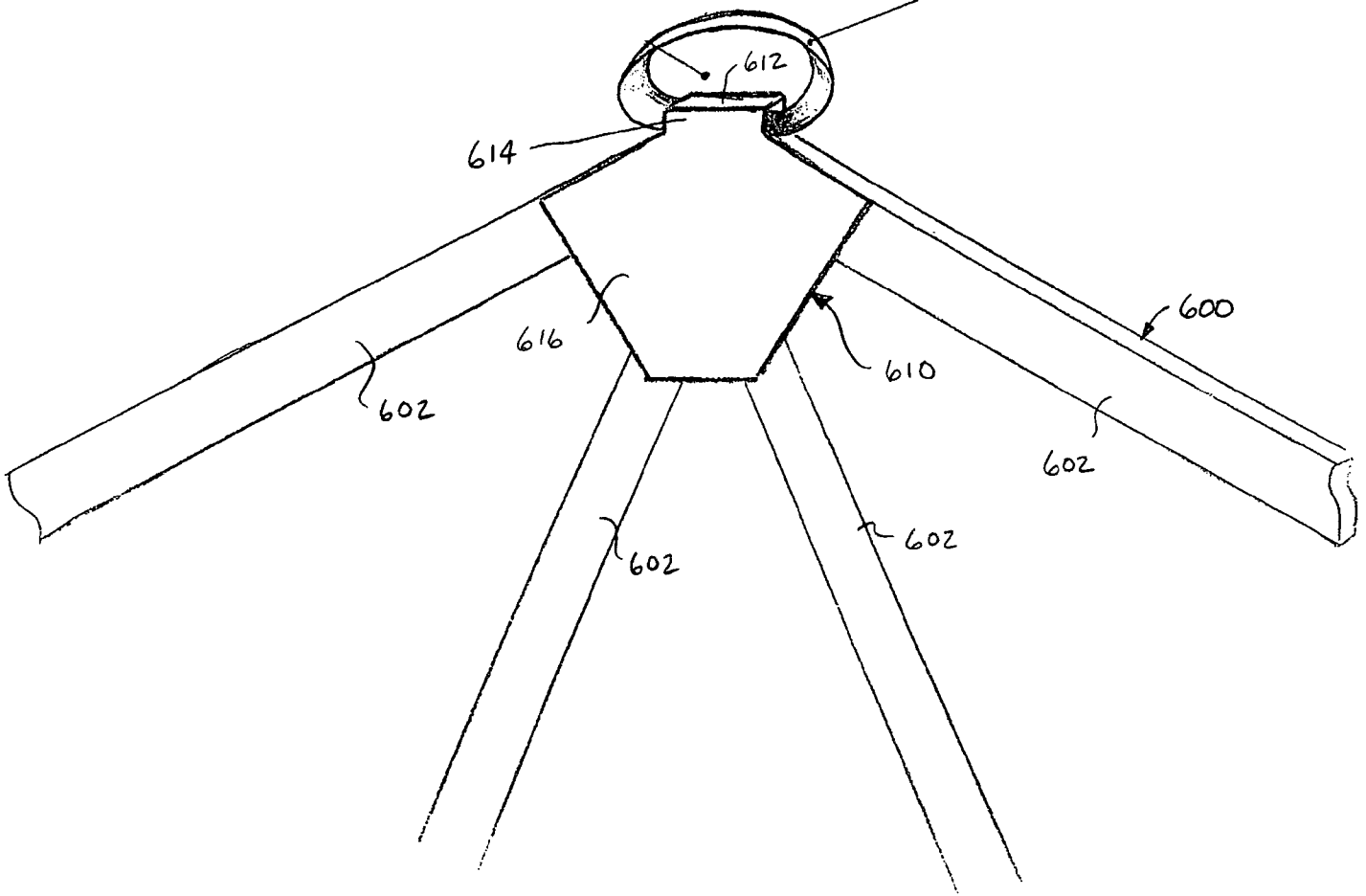
FIG. 20 is a partial perspective view of a truss formed with the peak gusset of FIG. 18 shown with a metal loop.
Figure 21:
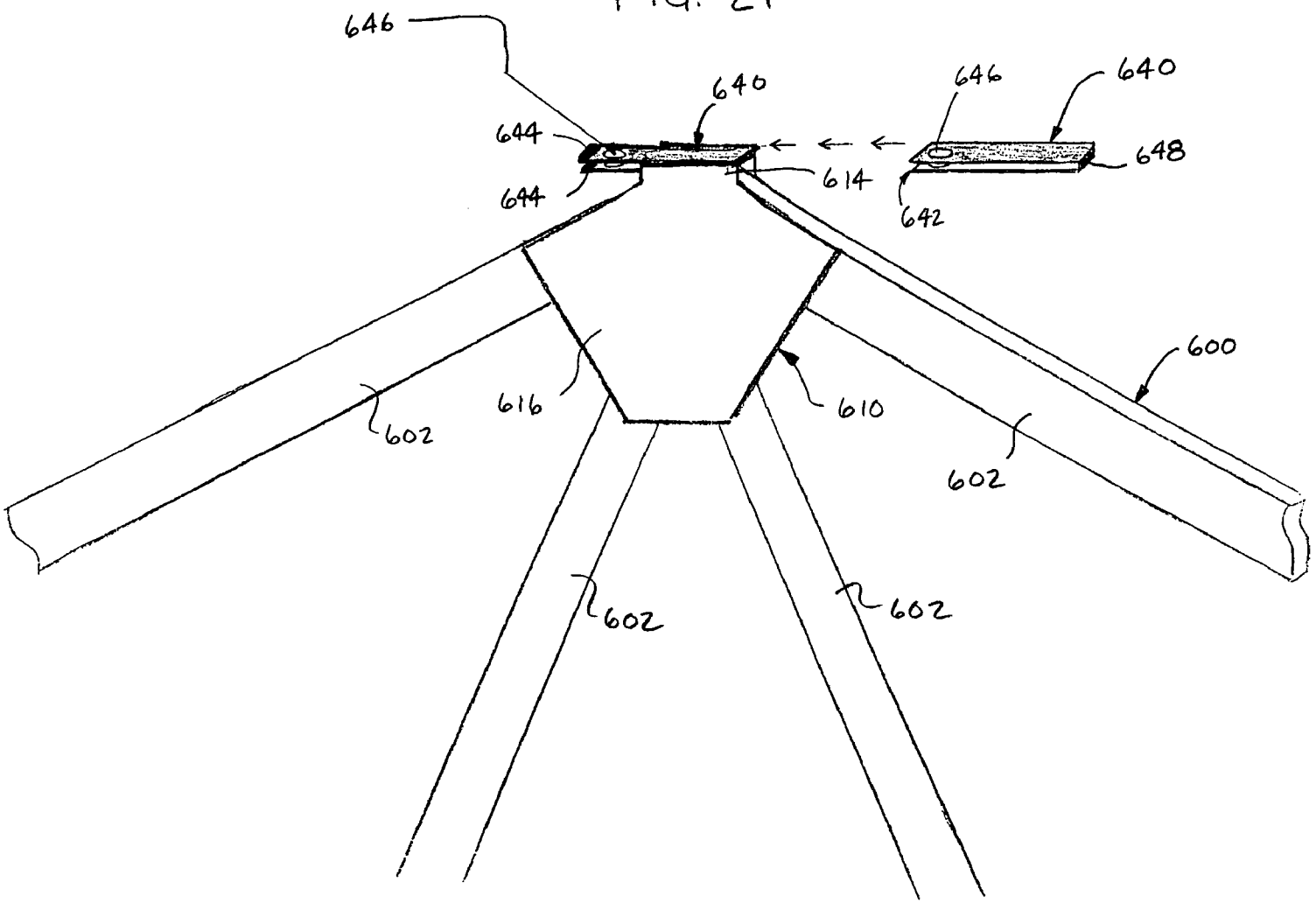
FIG. 21 is a partial perspective view of a truss formed with the peak gusset of FIG. 18 shown with a slide clip.

The peak gussets 10, 210, 310, 410, and 510 all have a significant extension of the anchor above the truss. The peak gusset of the present invention may also be configured in a "low profile" configuration. Referring now to FIGS. 18 and 19, a double peak gusset 610 is shown that is manufactured as one piece and then folded prior to attachment to form the truss 600. Double peak gusset 610 comprises a connection portion 612 between the anchor portions 614 of the double gusset 610. A plurality of teeth (not shown) extend perpendicularly from each plate portion 616. The double peak gusset 610 is folded on either end of connection portion 612 and attached to form a truss 600 by the plurality of teeth (not shown) engaging the truss members 602 as shown in FIG. 19 such that the connection portion 612 forms a cap over the anchor portions 614. The peak gusset anchor portions 614 only extend a short distance above the peak of the truss 600 and remain connected by connection portion 612, providing enhanced strength. The attached peak gusset 610 is shown in a partial perspective view in FIG. 20 including a metal loop 630 which provides an attachment location for a harness cable hook up (not shown). Another variation is shown in FIG. 21 wherein a slide clip 640 is used to provide an attachment location for a harness cable hook up (not shown). Slide clip 640 is a U-shaped metal band. Connection portion 612 of the peak gusset 610 is positioned between the legs 644 of the open end 642 of slide clip 640. Apertures 646 in the legs 644 of clip 640 provide an attachment location for a harness cable hook up. The harness cable hook up and the closed end 648 of slide clip 640 act to secure the slide clip to the peak gusset 610. The low profile of the anchor portions 614 and connection portion 612 make it so they can remain in place and simply be covered by the roof peak vent (not shown), or by ridge shingles. Alternatively, the anchor portions 614 and connection portion 612 can be removed or bent out of the way as in previous embodiments.

Figure 23:
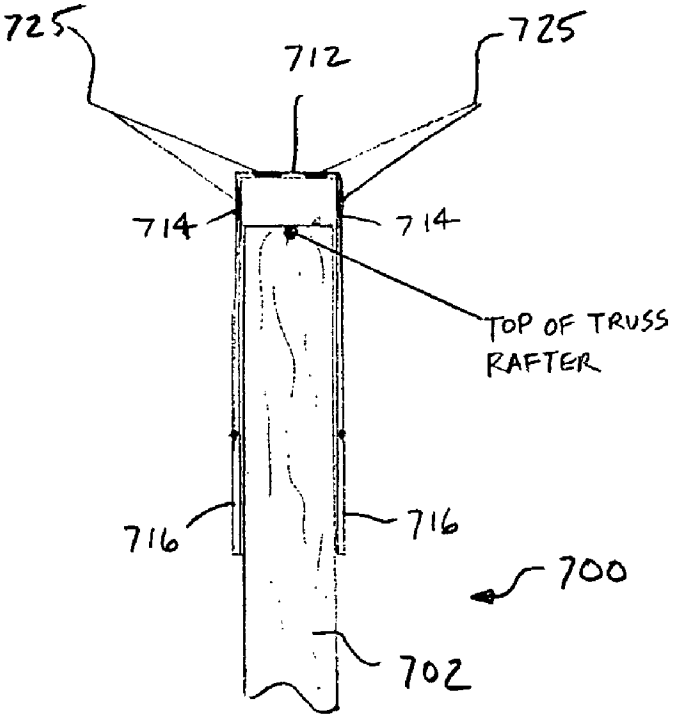
FIG. 23 is a side view of the peak gusset of FIG. 22, shown attached to a truss rafter.
Figure 22:
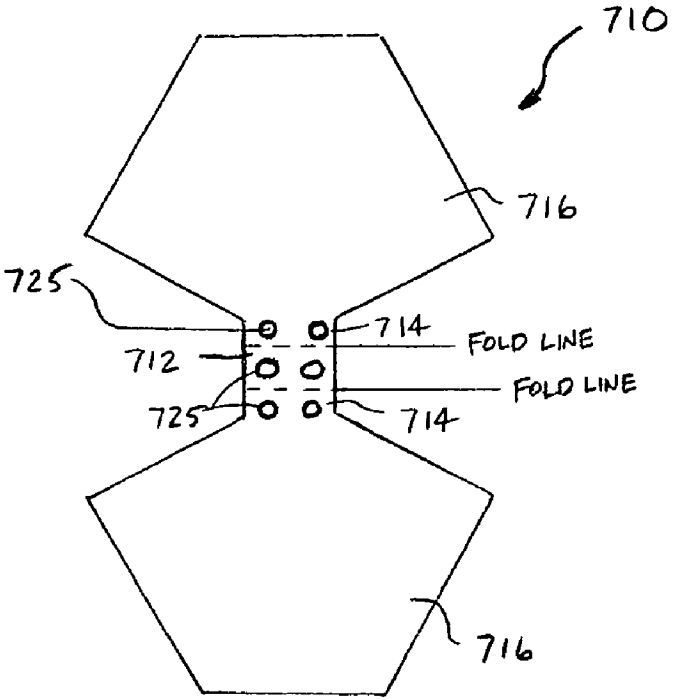
FIG. 22 is a front view of a second low anchor profile embodiment of the peak gusset of the present invention shown in a single piece configuration.
Figure 24:
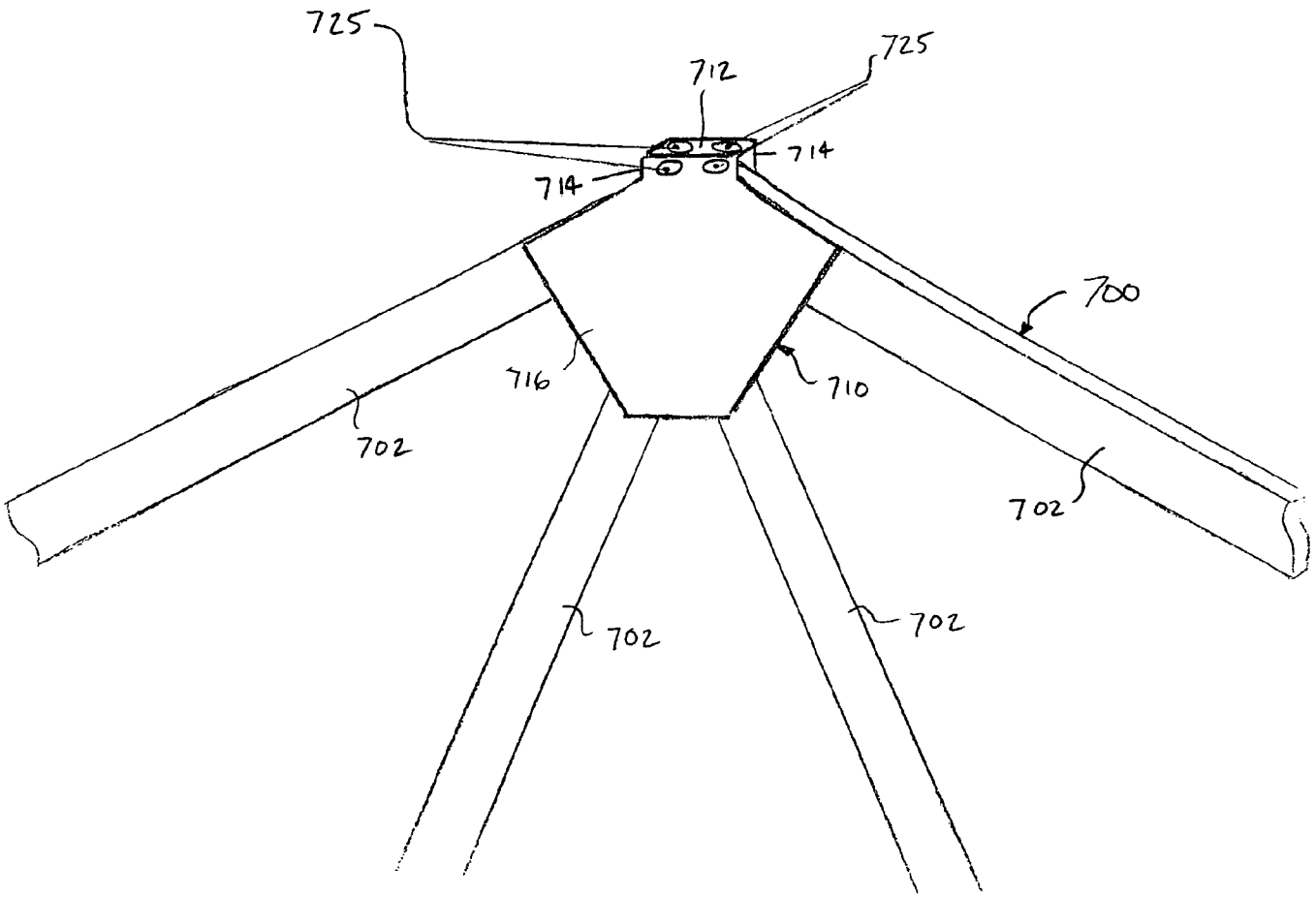
FIG. 24 is a partial perspective view of a truss formed with the peak gusset of FIG. 22.

Referring now to FIGS. 22 and 23, a second embodiment of a low profile double peak gusset 710 is shown. Peak gusset 710 is manufactured as one piece and then folded prior to attachment to form the truss 700. Double peak gusset 710 comprises a connection portion 712 between the anchor portions 714 of the double gusset 710. A plurality of teeth (not shown) extend perpendicularly from each plate portion 716. A plurality of apertures 725 are formed in the anchor portions 714 and/or the connection portion 712. The double peak gusset 710 is folded on either end of connection portion 712 and attached to form a truss 700 by the plurality of teeth (not shown) engaging the truss members 702 as shown in FIG. 24. Apertures 725 provide an attachment location for a harness cable hook up. As with the previous embodiment, the low profile of the anchor portions 714 and connection portion 712 make it so they can remain in place and simply be covered by the roof peak vent (not shown) or ridge shingles. Alternatively, the anchor portions 714 and connection portion 712 can be removed or bent out of the way as in previous embodiments.

Figure 27:
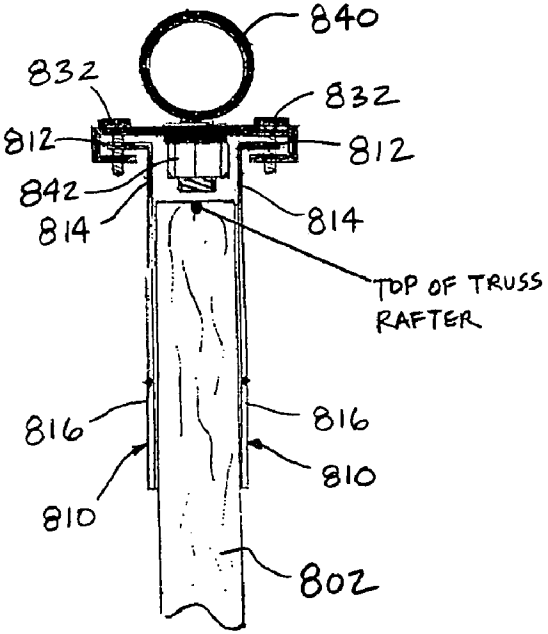
FIG. 27 is a side view of the peak gusset of FIG. 25, shown attached to a truss rafter with a slide-on eyebolt base and eyebolt attached to the peak gusset.
Figure 26:
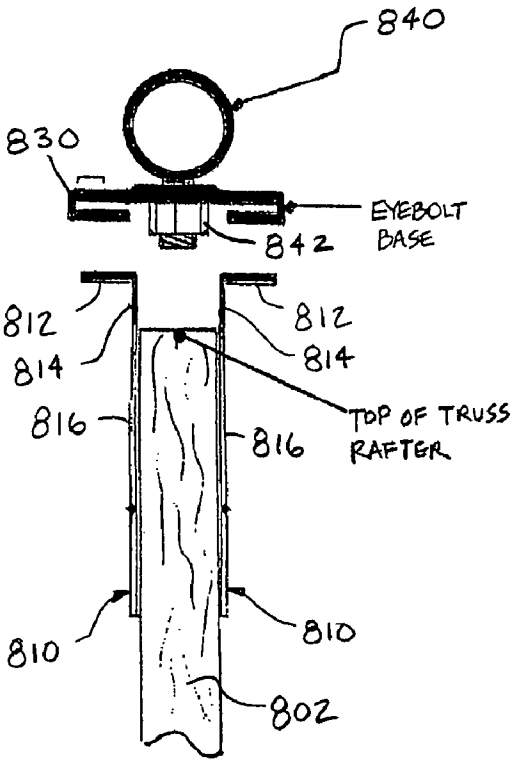
FIG. 26 is a side view of a the peak gusset of FIG. 25, shown attached to a truss rafter with an unattached slide-on eyebolt base and eyebolt.
Figure 25:
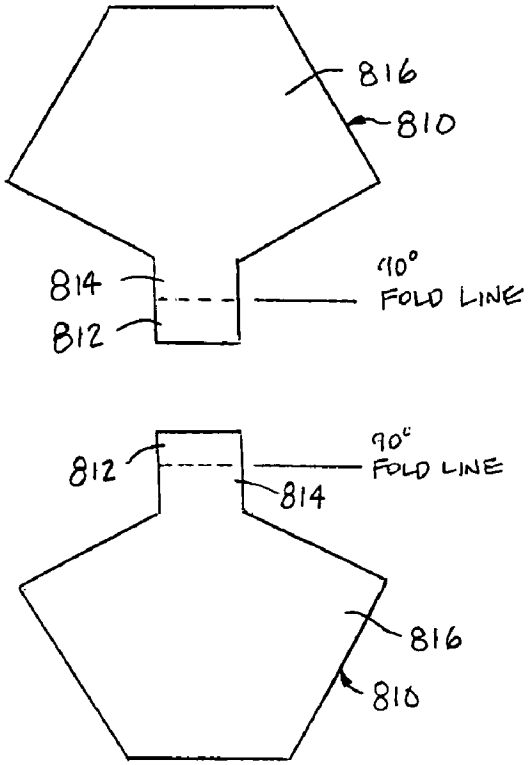
FIG. 25 is a front view of another embodiment of the peak gusset of the present invention.
Figure 28:
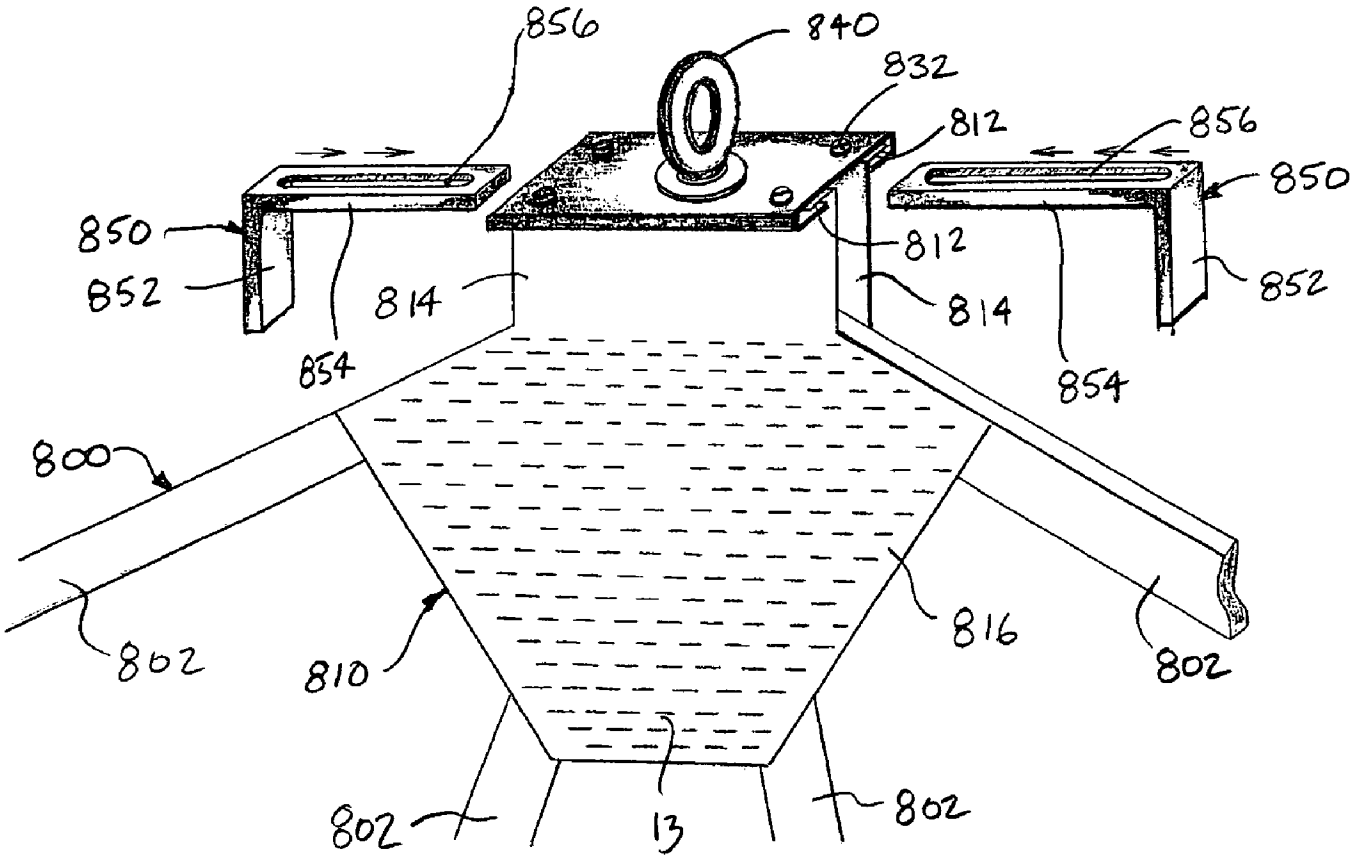
FIG. 28 is a partial perspective view of a truss formed with the peak gusset of FIG. 27 shown with a plurality of support members shown exploded therefrom.

Referring now to FIGS. 25-28, another embodiment of the peak gusset 810 is shown. Peak gusset 810 comprises a plate portion 816 and an anchor portion 814 extending therefrom and having a connection portion 812. A plurality of teeth (not shown) extend perpendicularly from each plate portion 816. The gusset plates 810 are attached to form a truss 800 by the plurality of teeth (not shown) engaging the truss members 802 as shown in FIG. 26. The connection portions 812 are folded outward from the anchor portion 814 of the gusset plates 810 to form a connection flange for a slide-on eyebolt base 830 having an eyebolt 840 attached thereto by a fastener 842. The eyebolt base 830 is slid over flanges 812 and secured thereto with a plurality of fasteners 832 as shown in FIG. 27. The attached peak gusset 810 is shown in a partial perspective view in FIG. 28 attached to truss 800. In order to provide additional strength for the eyebolt connection 840, a pair of support angles 850 are provided. The support angles 850 each have a leg 852 that engages the top of the rafter 802 and a second leg 854, perpendicular to leg 852, which generally spans the width of the anchor portion 814. The support angles 850 are designed such that the legs 854 nest one under the other. A slot 856 is formed in the legs 854 to allow the shaft of eyebolt 840 to pass through. The support angles 850 are fixed in position by eyebolt 840 and fastener 842.

Figure 29:
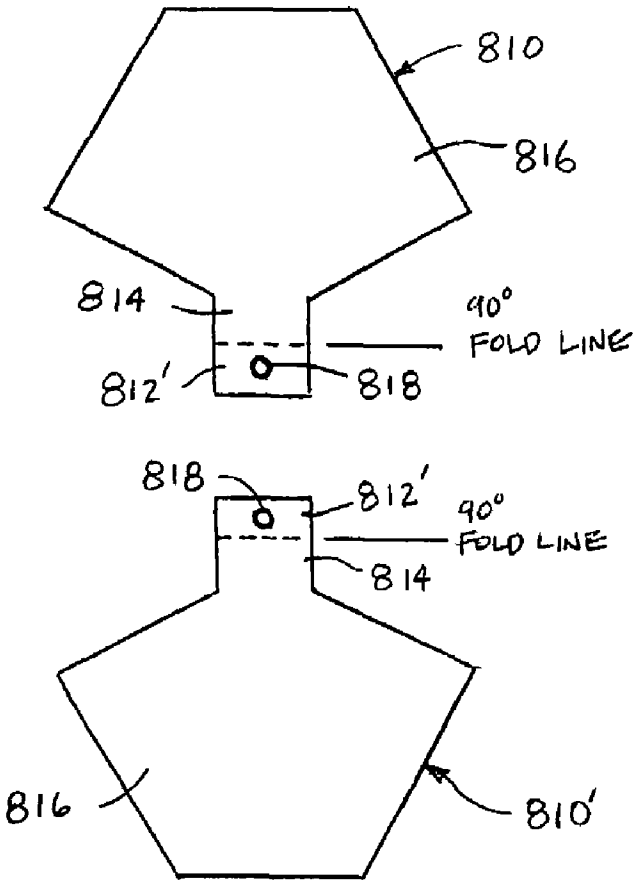
FIG. 29 is a front view of another embodiment of the peak gusset of the present invention similar to the embodiment of FIG. 25.
Figure 30:
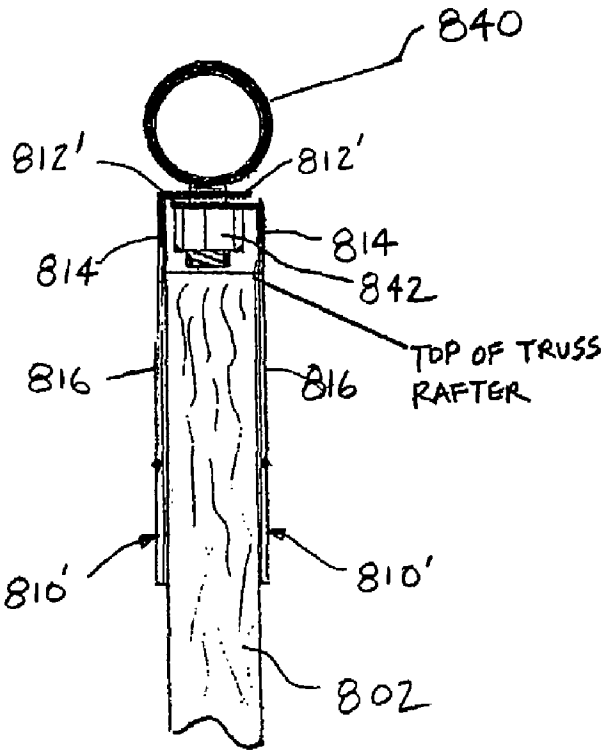
FIG. 30 is a side view of the peak gusset of FIG. 29, shown attached to a truss rafter with an eyebolt attached to the peak gusset.
Figure 31:
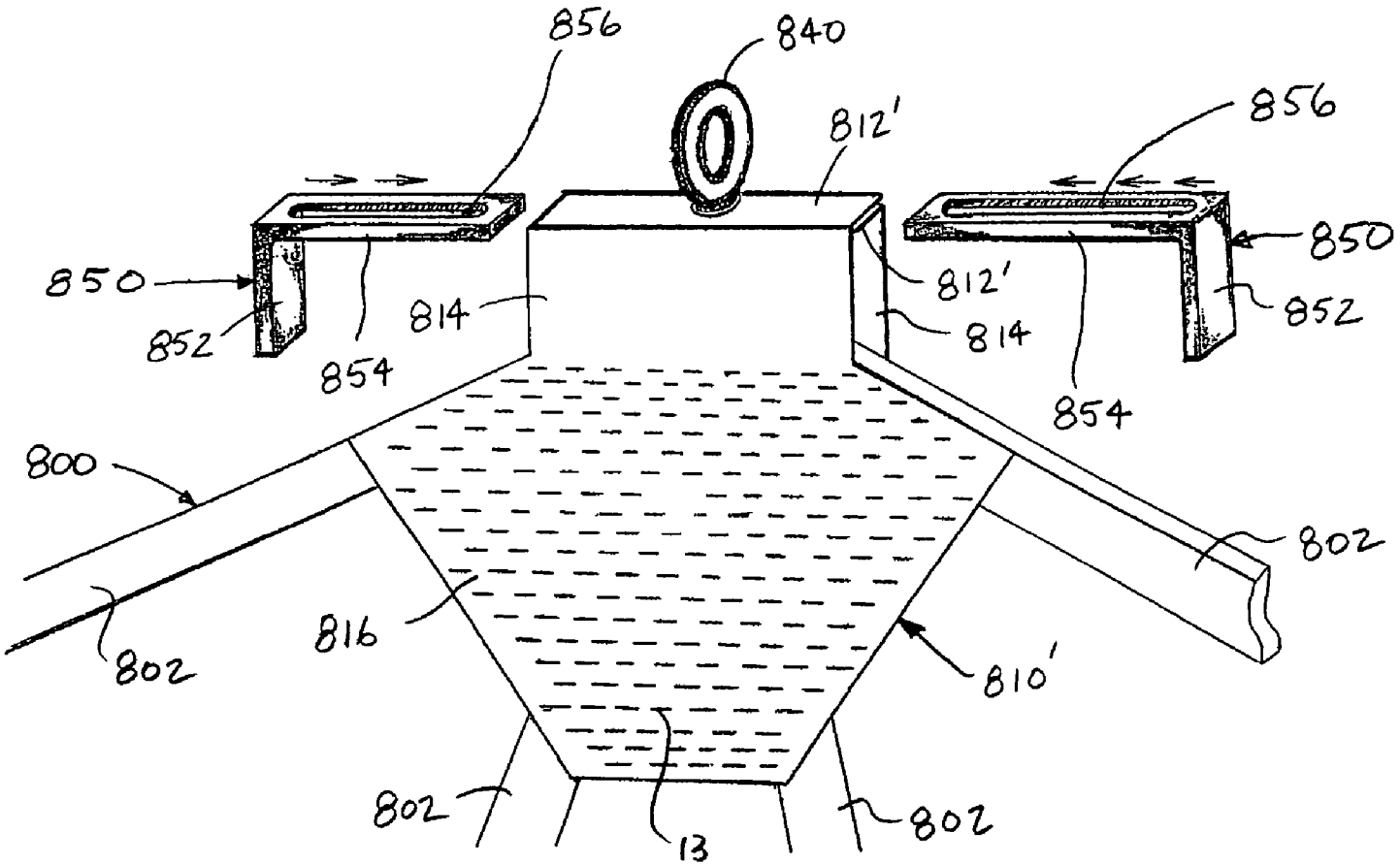
FIG. 31 is a partial perspective view of a truss formed with the peak gusset of FIG. 30 shown with a plurality of support members shown exploded therefrom.

Another variation of this embodiment is shown in FIGS. 29-31. In the embodiment shown in FIG. 29 the gusset plates 810' have an aperture 818 formed in connection portion 812'. As with the previous embodiment, the gusset plates 810' are attached to form a truss 800 by the plurality of teeth (not shown) engaging the truss members 802 as shown in FIG. 30. However, the connection portions 812' are folded inward from the anchor portions 814 of the gusset plates 810' such that the apertures 818 are aligned to allow the shaft of eyebolt 840 to pass and for the eyebolt 840 to be directly attached to the connection portions 812' by a fastener 842. The attached peak gusset 810' is shown in a partial perspective view in FIG. 31 attached to truss 800. In order to provide additional strength for the eyebolt connection 840, the pair of support angles 850 are provided as previously discussed and shown in FIG. 28.

Figure 33:
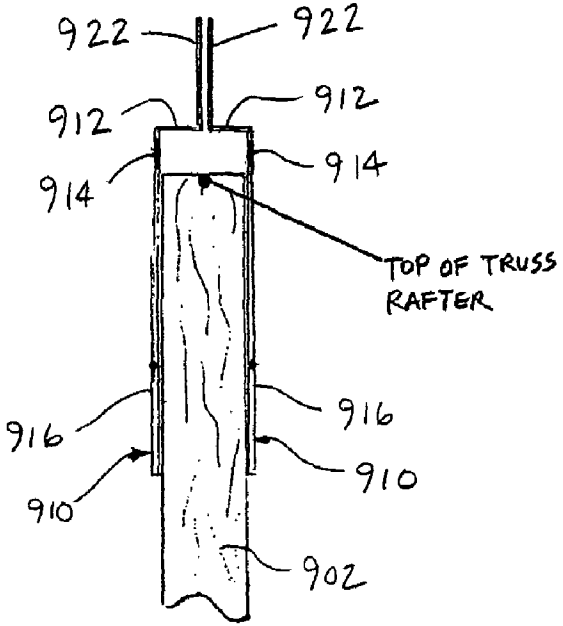
FIG. 33 is a side view of the peak gusset of FIG. 32, shown attached to a truss rafter.
Figure 32:
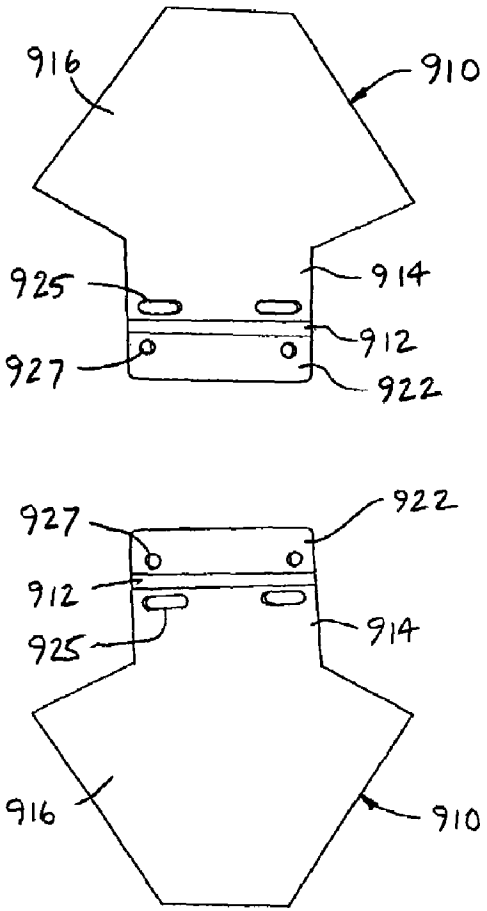
FIG. 32 is a front view of another embodiment of the peak gusset of the present invention utilizing gusset plates with a double fold.
Figure 34:
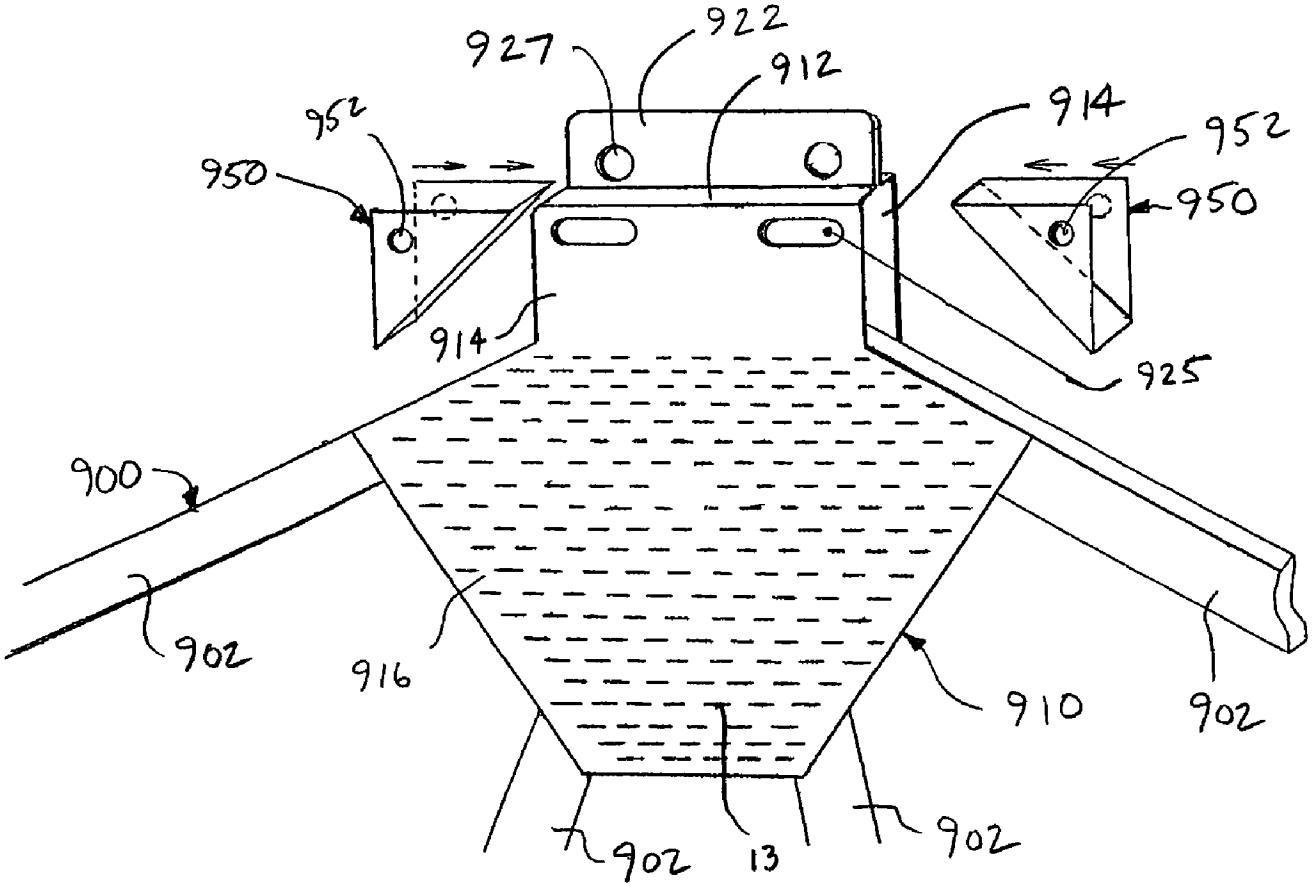
FIG. 34 is a partial perspective view of a truss formed with the peak gusset of FIG. 32 shown with a plurality of support members shown exploded therefrom.

Referring now to FIGS. 32-34, another embodiment of the peak gusset 910 is shown. As shown in FIG. 32, a pair of peak gussets 910 each comprises a plate portion 916 and an anchor portion 914 extending therefrom and having a connection portion 922 having at least one aperture 927 and a shoulder portion 912 having at least one aperture 925. A plurality of teeth (not shown) extend perpendicularly from each plate portion 916. The gusset plates 910 are attached to form a truss 900 by the plurality of teeth (not shown) engaging the truss members 902 as shown in FIG. 33. The shoulder portions 912 are folded inward from the anchor portion 914 of the gusset plates 910 and connection portions 922 are folded away from anchor portion 914 such that connection portions 922 and anchor portion 914 are generally parallel to each other. The attached peak gussets 910 are shown in a partial perspective view in FIG. 34 attached to truss 900. In order to provide additional strength for the anchor portion 912, a pair of support block wedges 950 are provided. The support blocks 950 each are configured to engage the top of the rafter 902 and the interior of shoulder portion 912. The support blocks 950 include an aperture 952 that is aligned with aperture 925 of the anchor portion to allow the support block 950 to be fastened to the gusset plates 910 by a fastener (not shown). The apertures 927 in the connection portion 922 provide anchor connection locations for users. It is noted that the support block wedge 950 is shown with open sides and a closed bottom. This allows access such that the hard shaft of the support block fastener can be used as an alternate hook location for the safety line carbiner.

Figure 36:
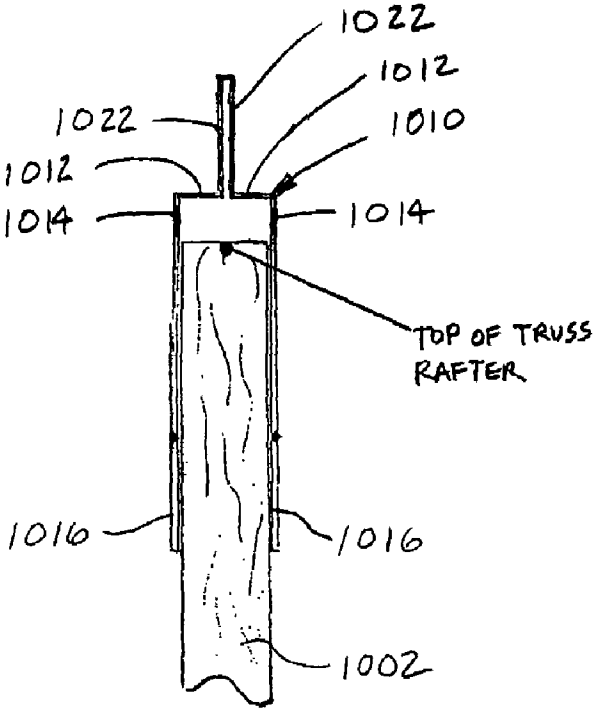
FIG. 36 is a side view of the peak gusset of FIG. 35, shown attached to a truss rafter.
Figure 35:
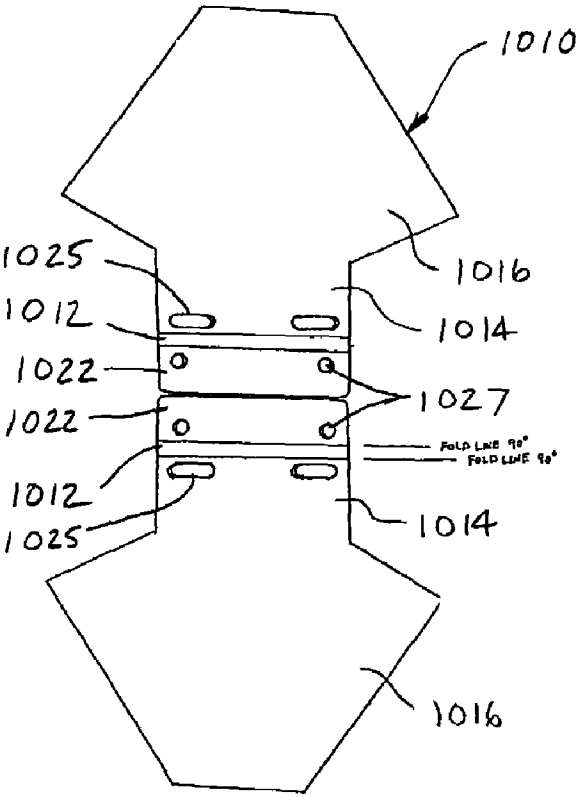
FIG. 35 is a front view of another embodiment of the peak gusset of the present invention, which is a one-piece version of the gusset plates of FIG. 32.

Another embodiment of the invention is shown in FIGS. 35 and 36 and is a double gusset version of the embodiment shown in FIGS. 32-34. A double peak gusset 1010 is shown that is manufactured as one piece and then folded prior to attachment to form the truss. Double peak gusset 1010 comprises a pair of shoulder portions 1012 and a pair of connection portions 1022 each having at least one aperture 1027, between the anchor portions 1014 of the double gusset 1010. The shoulder portions 1012 are folded inward from the anchor portions 1014 of the double gusset plate 1010 and connection portions 1022 are folded away from anchor portions 1014 such that connection portions 1022 and anchor portion 1014 are generally parallel to each other. A plurality of teeth (not shown) extend perpendicularly from each plate portion 1016. The double peak gusset 1010 is folded and attached to form a truss by the plurality of teeth (not shown) engaging the truss members 1002 as shown in FIG. 36. As with the previous embodiment, it is contemplated that support blocks 950 could be used to strengthen the anchor portion 1014.

Although the present invention has been described above in detail, the same is by way of illustration and example only and is not to be taken as a limitation on the present invention. It is understood that many variations of the illustrated invention are possible without departing from the scope of the present invention. Accordingly, the scope and content of the present invention are to be defined only by the terms of the appended claims.

The invention claimed is:

1. A roof anchor safety system comprising:

a pair of monolithic connector members, each monolithic connector member comprising a mounting plate portion having a plurality of teeth extending perpendicularly therefrom and an anchor portion extending from and at least partially coplanar with the mounting plate portion;

wherein the mounting plate portion of the monolithic connector members are attached to opposite sides of a truss such that the anchor portion of each monolithic connector member extends beyond an edge of the truss and outward from the truss; and at least one safety device supported by the monolithic connector members.

2. The roof anchor system of claim 1, wherein the mounting plate portions of the monolithic connector members connect a plurality of truss members at a peak of the truss.

3. The roof anchor system of claim 1, wherein the mounting plate portions of the monolithic connector members connect at least one truss member to another truss member.

4. The roof anchor system of claim 1, wherein the mounting plate portions of the monolithic connector members are mounted to a single truss member.

5. The roof anchor system of claim 1, further comprising a support member positioned between the anchor portions of the monolithic connector members.

6. The roof anchor system of claim 5 further comprising an anchor extension member that is attached over the anchor portions of the monolithic connector members and the support member positioned between the anchor portions of the monolithic connector members, wherein the anchor extension member extends beyond the anchor portions and outward from the truss.

7. The roof anchor system of claim 1 further comprising an anchor extension member that is attached to the anchor portions of the monolithic connector members and extends beyond the anchor portions and outward from the truss.

8. The roof anchor system of claim 1, wherein the anchor portions of the monolithic connector members include at least one aperture for connection of the safety device.

9. The roof anchor system of claim 1, wherein the pair of monolithic connector members attached to the opposite sides of the truss are connected to each other forming a monolithic double connector member.

10. A method of providing a roof anchor safety system comprising the steps of:

providing a monolithic connector member comprising a mounting plate portion having a plurality of teeth extending perpendicularly therefrom and an anchor portion extending from the mounting plate portion, the anchor portion including means for attaching a safety device;

attaching the mounting plate portion of the monolithic connector member wherein at least one safety device comprises a harness line or a tether line to a truss such that the plurality of teeth engage a wooden portion of the truss and the anchor portion extends beyond an edge of the truss and outward away from the truss;

attaching a safety device to the anchor portion and subsequently removing the safety device; and, bending the anchor portion to provide clearance for building materials to be installed proximate to the connector member.

11. The method of claim 10, wherein the step of attaching the mounting plate portion of the monolithic connector member to a truss is accomplished on a single truss member of the truss.

12. The method of claim 10, wherein the step of attaching the mounting plate portion of the monolithic connector member to a truss is accomplished at a location attaching at least one truss member to another truss member.

13. The method of claim 10, further comprising the steps of:

providing a second monolithic connector member comprising a second mounting plate portion having a plurality of teeth extending perpendicularly therefrom and an second anchor portion extending from the second mounting plate portion, the second anchor portion including second means for attaching a safety device; and, attaching the second monolithic connector member to the truss on a side of the truss opposite the first monolithic connector member before the optional step of attaching a safety device to the anchor portion and subsequently removing the safety device.

14. The method of claim 10, wherein the anchor portion is at least partially coplanar with the mounting plate portion.

* * * * *